US007641063B2

(12) United States Patent
Wishart et al.

(10) Patent No.: US 7,641,063 B2
(45) **Date of Patent: *Jan. 5, 2010**

(54) MODULAR RACK CONVERSION APPARATUS AND METHOD

(75) Inventors: Andrew S. Wishart, Massapequa, NY (US); Steven C. Thompson, Elkhart, IN (US)

(73) Assignee: L&P Property Management Company, South Gate, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/293,920

(22) Filed: Dec. 5, 2005

(65) Prior Publication Data

US 2007/0119808 A1 May 31, 2007

(51) Int. Cl.
*A47B 43/00* (2006.01)

(52) U.S. Cl. ..... 211/189

(58) Field of Classification Search ..... 211/189, 211/175, 184, 187, 191, 190, 186
See application file for complete search history.

(56) References Cited

U.S. PATENT DOCUMENTS

| | | | | |
|---|---|---|---|---|
| 865,268 | A | 9/1907 | Powell | |
| 1,169,720 | A | 1/1916 | Harris | |
| 1,736,883 | A | 11/1929 | MacDonald | |
| 2,276,440 | A | 3/1942 | Walsh | |
| RE24,535 | E | 9/1958 | Franks | |
| 2,895,619 | A * | 7/1959 | Frazier | 211/192 |
| 2,984,363 | A | 5/1961 | Lang et al. | |
| 3,072,262 | A | 1/1963 | Cassel | |
| 3,152,670 | A | 10/1964 | Selkregg, Jr. et al. | |
| 3,194,407 | A | 7/1965 | D'Altrui | |
| 3,463,325 | A * | 8/1969 | Rogers et al. | 211/191 |
| 3,519,140 | A | 7/1970 | Wellman, Jr. | |
| 3,545,626 | A * | 12/1970 | Seiz | 211/192 |

(Continued)

FOREIGN PATENT DOCUMENTS

| | | |
|---|---|---|
| DE | 29803113 | 2/1998 |

(Continued)

OTHER PUBLICATIONS

Madix Store Fixtures, Omega System Installation Instruction ASY-130, Oct. 1, 1998, 16 pages, USA.

(Continued)

*Primary Examiner*—Jennifer E. Novosad
(74) *Attorney, Agent, or Firm*—Michael Best & Friedrich LLP

(57) ABSTRACT

Some embodiments of the present invention provide structure that can be installed within a warehouse-type rack to convert the rack for use as a merchandise and display rack. In this manner, warehouse-type racks can be provided with a greater degree of adjustability to accommodate a larger number of shelving and product storage and display configurations. The structure installed within a warehouse-type rack can include secondary uprights connected to secondary front-rear stretchers. Preferably, the connections between the secondary uprights and the secondary front-rear stretchers are adjustable so that the secondary uprights can be secured in different positions within the warehouse-type rack. In some embodiments, the secondary uprights can be secured in different front-rear positions in the rack and/or can be secured in different vertical positions with respect to the secondary front-rear stretchers.

13 Claims, 16 Drawing Sheets

U.S. PATENT DOCUMENTS 3,695,456 A 10/1972 Lewis
4,078,664 A * 3/1978 McConnell ..... 211/189
4,444,322 A 4/1984 Lee
4,763,579 A 8/1988 Cibulak
4,818,044 A 4/1989 Dobry
4,955,490 A 9/1990 Schafer
5,012,938 A 5/1991 King
5,013,100 A 5/1991 Zich
5,090,579 A 2/1992 Major
5,160,051 A 11/1992 Bustos
5,205,421 A 4/1993 Bustos
5,257,701 A 11/1993 Edelson
5,279,430 A 1/1994 Benton
5,379,905 A 1/1995 Bustos et al.
5,427,255 A 6/1995 Nook
5,472,103 A 12/1995 Merl
5,474,412 A 12/1995 Pfeiffer et al.
5,477,971 A 12/1995 Howard
5,593,048 A 1/1997 Johnson
5,628,415 A * 5/1997 Mulholland ..... 211/189
5,678,702 A 10/1997 Menaged et al.
5,749,481 A 5/1998 Miller
5,769,247 A 6/1998 Merl
5,899,035 A 5/1999 Waalkes et al.
5,918,750 A 7/1999 Jackson
6,021,613 A 2/2000 Reuter et al.
6,029,833 A 2/2000 Yeh
6,164,467 A 12/2000 DePottey et al.
6,260,719 B1 * 7/2001 Azzopardi et al. ..... 211/189
6,286,693 B1 * 9/2001 Brown ..... 211/181.1
6,561,365 B2 5/2003 Bustos
6,739,463 B2 5/2004 Wishart et al.
6,978,906 B2 * 12/2005 Wishart et al. ..... 211/189

FOREIGN PATENT DOCUMENTS

DE 29904707 3/1999

OTHER PUBLICATIONS

European Patent Office Supplemental European Search Report, dated Jan. 10, 2007.

* cited by examiner

MODULAR RACK CONVERSION APPARATUS AND METHOD

CROSS-REFERENCE TO RELATED APPLICATIONS

Priority is hereby claimed to U.S. patent application Ser. No. 10/824,007 filed on Apr. 14, 2004, U.S. patent application Ser. No. 10/155,851 filed on May 24, 2002, United States Provisional Patent Application Ser. No. 60/378,773 filed on May 8, 2002, and United States Provisional Patent Application Ser. No. 60/293,954 filed on May 25, 2001, the entire contents of which are incorporated herein by reference.

FIELD OF THE INVENTION

The present invention relates to racks, and more particularly to adjustable racks and rack systems for storing and displaying merchandise and other items, methods of assembling such racks and rack systems, and components of such racks and rack systems.

BACKGROUND

Conventional warehouse-type racks are increasingly used in applications for which they were not initially designed. Previously, such racks were commonly employed in storage and warehouse facilities to store and organize products in bulk form. However, for purposes of cost-savings and with the increased popularity of warehouse-type stores, many users now employ warehouse-type racks in retail establishments. Although such racks are strong, durable, and are capable of storing large quantities of product, a number of drawbacks exist in using warehouse-type racks to display and store merchandise (as well as for other purposes).

By way of example only, conventional warehouse-type racks are significantly limited in their adjustability—and hence the different shelving configurations possible—due to the relatively large sizes of the rack components. In many warehouse-type racks, stretchers extend laterally and in front-rear directions in order to connect vertically-extending uprights. Such uprights typically have a limited number locations to which the stretchers can be connected. This limitation is at least partially the product of the heavy-duty design of such racks, which are intended to carry much larger loads than relatively light-duty merchandise racks and displays found in most retail establishments.

As another example, warehouse-type racks are not well-suited to display and store merchandise and other product in more than a limited number of manners. Typically, warehouse-type racks have relatively large shelves each providing an open space upon which product can be stored. Although well-suited for storing large quantities of product in a limited amount of space, such racks are not well-suited for displaying merchandise, for efficiently storing and displaying smaller quantities of product (e.g., merchandise in unbundled form, individually-wrapped products, and the like), for permitting easy adjustment of shelving and displays, and for other purposes.

SUMMARY OF THE INVENTION

Some embodiments of the present invention provide structure that can be installed within a warehouse-type rack to convert such a rack for use as a merchandise and/or display rack. In this manner, warehouse-type racks can be provided with a significantly greater degree of adjustability to accommodate a greater number of shelving and/or product storage and display configurations.

In some embodiments, the structure installed within a warehouse-type rack includes one or more of the following components: secondary front-rear stretchers, secondary uprights connecting upper and lower secondary front-rear stretchers on the rack, stabilizer bars connecting secondary front-rear stretchers together, support spacers connecting secondary uprights and/or secondary front-rear stretchers, and display walls or panels directly or indirectly connected to the secondary uprights and/or secondary front-rear stretchers.

Preferably, the secondary uprights are adjustably connected to the secondary front-rear stretchers so that the secondary uprights can be secured in different positions within the warehouse-type rack. In some embodiments, the secondary uprights can be secured in different front-rear positions in the rack. In other embodiments, the secondary uprights can be secured in different vertical positions with respect to the secondary front-rear stretchers. In still other embodiments the secondary uprights can be secured in different front-rear positions and can be secured in different vertical positions with respect to the secondary front-rear stretchers.

The structure of the present invention preferably enables a user to convert a warehouse-type rack to a storage and display rack that is more suited for a retail environment, is better adapted for displaying different merchandise and other product, and/or has increased adjustability to meet the demands of different users and applications.

BRIEF DESCRIPTION OF THE DRAWINGS

The present invention is further described with reference to the accompanying drawings, which show preferred embodiments of the present invention. However, it should be noted that the invention as disclosed in the accompanying drawings is illustrated by way of example only. The various elements and combinations of elements described below and illustrated in the drawings can be arranged and organized differently to result in embodiments which are still within the spirit and scope of the present invention.

DETAILED DESCRIPTION OF THE PREFERRED EMBODIMENTS

Figure 1:
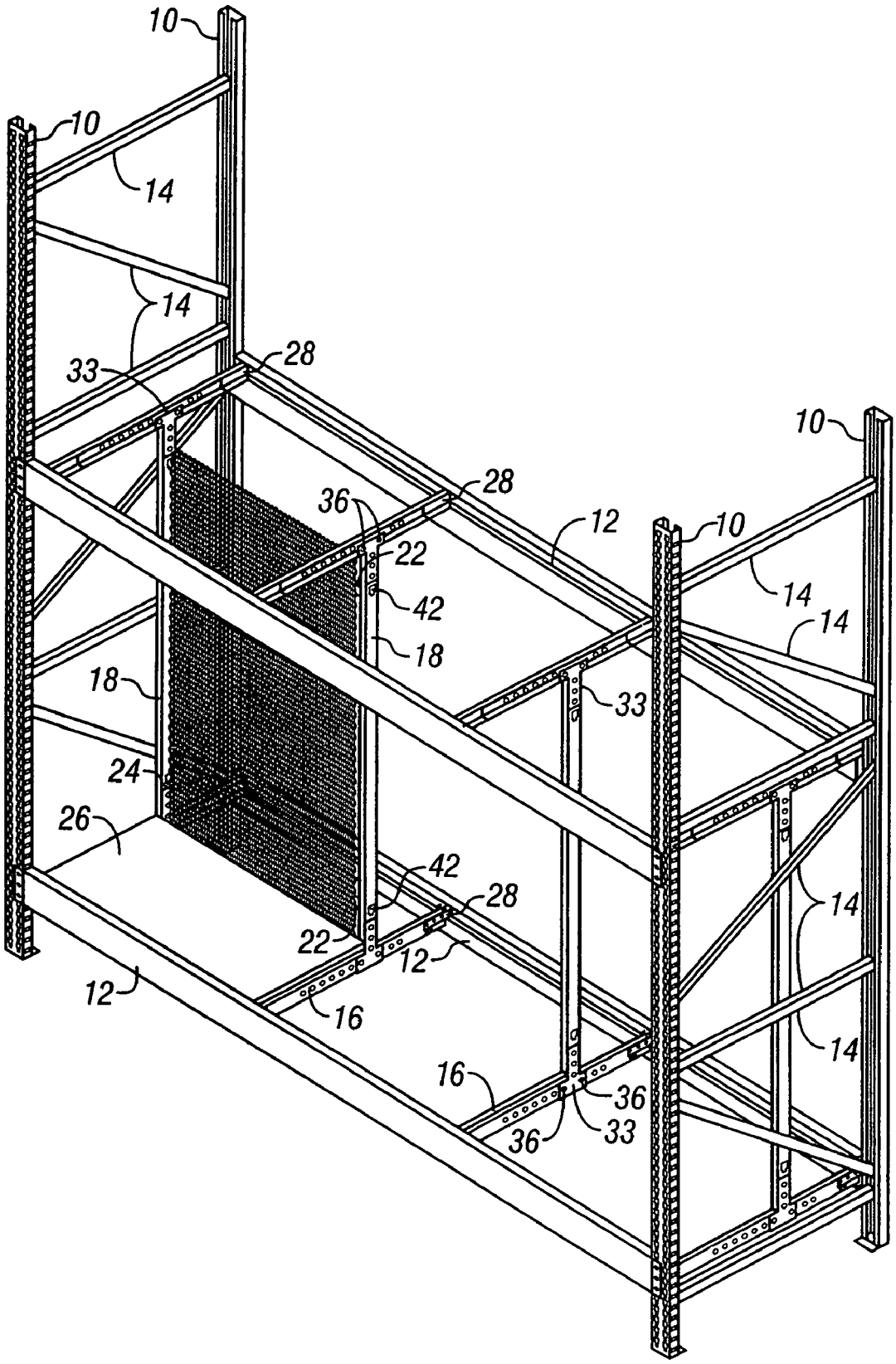
FIG. 1 is a perspective view of a rack assembly according to a first preferred embodiment of the present invention, shown partially assembled and without shelving installed.

As shown in FIG. 1, standard warehouse-type rack systems usually employ a number of uprights 10 connected together by lateral stretchers 12 and front-rear stretchers 14, both horizontal and diagonal. The uprights 10 and stretchers 12, 14 can be tubular or solid and can have any cross sectional shape. By way of example only, the uprights 10 and/or stretchers 12, 14 can have a variety of cross sections as may be required or desirable, such as hollow rectangular, C-shaped, round, or I- or L-shaped. These elements also can be solid bars or rods or have other polygonal cross sections with flanges, extensions, and other features as needed, and the like. One popular rack style is illustrated in the figures, in which a number of C-shaped uprights 10 are connected together by lateral stretchers 12 having hollow stepped rectangular cross sections and by front-rear stretchers 14 having hollow rectangular cross sections. The uprights 10 and the stretchers 12, 14 can be made of any resilient material such as metal, composites, high-strength plastic, and the like. Most preferably, these elements are made of a relatively high-strength material such as steel, iron, or aluminum.

Front-rear stretchers can be connected in any conventional manner to the lateral stretchers, and can run perpendicularly or at any other angle with respect to the lateral stretchers 12. Still other types of stretchers can be employed as desired.

Typically, the uprights 10 are adjustably connected to either or both types of stretchers 12, 14. Adjustable connections between uprights 10 and stretchers 12, 14 can be accomplished in a number of different conventional manners. For example, the uprights 10 can have a series of apertures along all or part of their lengths into which pins, posts, keys, fingers, or other protrusions on the ends of the stretchers 12, 14 extend for connection to the uprights 10. Alternatively or in addition, conventional fasteners such as pins and mating apertures, threaded fasteners passed through either or both the uprights 10 and stretchers 12, 14, clamps, and interlocking flanges on the uprights 10 and stretchers 12, 14 can be employed. Still other manners of releasably and adjustably connecting the uprights 10 to either or both types of stretchers 12, 14 are conventional in nature and are not therefore described further herein.

In some types of racks, either or both types of stretchers 12, 14 are permanently connected to the uprights 10, such as by welding, brazing, riveting, or by forming the stretchers 12, 14 integrally with the uprights 10. In the illustrated preferred embodiment of FIGS. 1-9C, the uprights 10 are releasably connected to the lateral stretchers 12 by pins on the lateral stretchers 12 releasably inserted within mating apertures in the uprights 10. In this same embodiment, the front-rear stretchers 14 are permanently secured to the uprights 10 by welding. In this manner, the lateral stretchers 12 can be disconnected from upright and front-rear stretcher assemblies (which can then be easily stacked for storage or shipping, if desired).

The heights of shelves in the racks described above are dictated by the connection location of the stretchers employed to support the shelves. In this regard, the heights of shelves are determined by the heights of the front-rear stretchers 14 if the shelves rest upon and are supported by the front-rear stretchers 14, and are determined by the heights of the lateral stretchers 12 if the shelves rest upon and are supported by the lateral stretchers 12. In the illustrated preferred embodiment for example, the warehouse rack shelves are only supported by the lateral stretchers 12. Therefore, in this embodiment, the location of the connections between the lateral stretchers 12 and the uprights 10 (e.g., the upright apertures to which the lateral stretchers 12 are connected) determines the heights of the shelves in the rack.

As discussed above, the relatively large size of the stretchers 12, 14 in a conventional warehouse-type rack significantly limits the adjustability and the available shelving configurations of the rack. This is true regardless of the manner in which either or both types of stretchers 12, 14 are adjustably connected to the uprights 10. In some embodiments of the present invention, the conventional warehouse-type rack is provided with structure that increases the adjustability to accommodate a greater number of shelving configurations. In the illustrated preferred embodiment for example, the structure employed for this purpose includes secondary front-rear stretchers 16 supporting secondary uprights 18. Preferably, the present invention employs one or more stabilizer bars 20 for retaining the secondary front-rear stretchers 16 in desired positions on the lateral stretchers 12 of the warehouse-type rack and for strengthening the structure of the present invention, one or more support spacers 22 for increasing lateral strength and rigidity of the secondary uprights 18 and/or for connection of other display structure to be supported by the secondary uprights 18, one or more display panels or walls 24 (to which merchandise display and support elements can also be connected in some embodiments), and one or more shelves 26 upon which merchandise can be displayed and supported. Various embodiments of the present invention can employ any number (including none) of these additional elements as desired.

In addition to providing a secondary product support and display structure for conventional warehouse-type rack systems, the present invention preferably enables a user to position merchandise in an increased range of vertical and horizontal positions within a warehouse-type rack. Most preferably, the conversion rack assembly of the present invention enables a user to locate merchandise display and support elements such as shelves, buckets, baskets, hangers, and the like at any number of desired vertical, lateral, and front-rear positions within a warehouse-type rack. In some preferred applications, a user is capable of locating such elements in any position within an area defined by two levels of stretchers 12, and by the front, rear, and sides of the warehouse-type rack. In other preferred embodiments, the user is capable of locating such elements at least within a range of positions in this area.

The conversion rack assembly of the present invention can preferably be installed, removed, and adjusted within a warehouse-type rack without disturbing the warehouse-type rack itself. This provides significant advantages over conventional warehouse-type racks and other rack systems by making installation, removal, and adjustment simple and fast. Also, the adjustability of the conversion rack assembly of the present invention is much greater than that of the larger warehouse-type racks within which it is installed, providing a user with the same or similar display and storage options as offered in lighter-duty retail-type display and storage rack systems.

Although the structure of the present invention can be permanently incorporated into a warehouse-type rack (i.e., integral with such a rack), a removable conversion rack assembly is preferred because it enables a user to purchase and use standard warehouse-type racks and to install conversion rack assemblies only on an as-needed basis. Another advantage of the present invention is the fact that the conversion rack assembly does not require a separate support structure. Instead, the conversion rack assembly of the present invention preferably relies upon the support and ground-contacting structure of the warehouse-type rack in which it is installed. This reduces the cost, complexity, and assembly time of the present invention.

With reference to FIGS. 1, 2, and 3A-3C, the secondary front-rear stretchers 16 of the present invention preferably rest upon and are supported by the lateral stretchers 12 of the warehouse-type rack. The secondary front-rear stretchers 16 can have any shape and can be made of any preferably resilient material desired, including, without limitation, those described above with reference to the elements of the warehouse-type rack. In the illustrated preferred embodiment of FIGS. 1-9C, the secondary front-rear stretchers 16 are tubular members having rectangular cross-sections. Although the ends of the secondary front-rear stretchers 16 can rest upon the lateral stretchers 12 of the warehouse-type rack, the secondary front-rear stretchers 16 more preferably have flange supports 28 on their ends. These flange supports 28 provide an increased footprint for the secondary front-rear stretchers 16 and therefore increase the stability of the secondary front-rear stretchers 16 upon the lateral stretchers 12 of the warehouse-type rack. The flange supports 28 can be flat or bent plates which are welded, bolted, or connected in any other conventional manner to the ends of the secondary front-rear stretchers 16. The flange supports 28 can take other shapes providing the preferred increased footprint. In some highly preferred embodiments, the ends of the secondary front-rear stretchers 16 rest in a recessed lip of the lateral stretchers 12 of the warehouse-type rack. Although not required, this enables the secondary front-rear stretchers 16 to be recessed within the lateral stretchers 12 of the warehouse-type rack.

The secondary front-rear stretchers 16 in the warehouse-type rack can be retained in any number of desired positions along the lateral stretchers 12 in any conventional manner, such as by being bolted, clamped, or clipped to the lateral stretchers 12, by pin and aperture connections of the secondary front-rear stretchers 16 to the lateral stretchers 12 (e.g., pins, posts, fingers, or other protrusions on the ends of the secondary front-rear stretchers 16 removably received within apertures in the lateral stretchers 12 or vice-versa), by being received within recesses in the lateral stretchers 12, and the like.

Figure 18A:
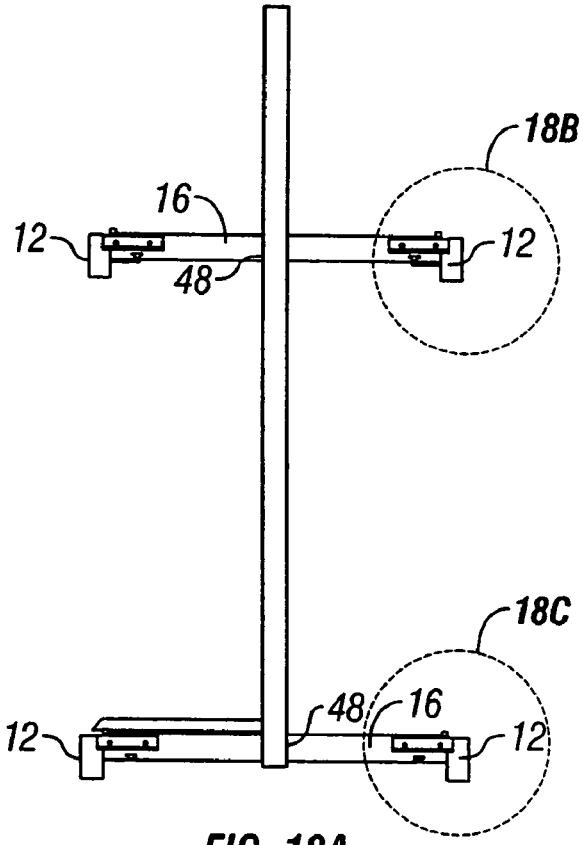
FIGS. 18A-18C are side elevational detail views of the rack assembly illustrated in FIG. 16.
Figure 18B:
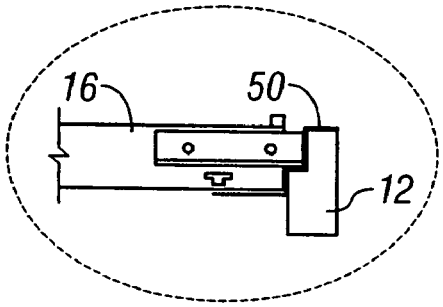
Figure 18C:
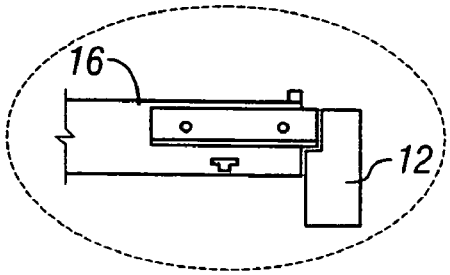

In some alternative embodiments, the elements or structure used to retain the front-rear stretchers 16 in desired positions along the lateral stretchers 12 require no conventional fasteners and no tools to install. For example, the upper front-rear stretchers 16 in the rack assembly illustrated in FIGS. 16-18C (described in greater detail below) rest upon plates 50 which are preferably shaped to rest upon the lateral stretchers 12 as best shown in FIG. 18B. These plates 50 can extend any length along the lateral stretchers 12, but preferably have substantially the same length as the width of their associated front-rear stretchers 16. The plates 50 can be made of any material desired, including any of the materials described herein used for other elements of the rack assembly. Also, the plates 50 (if employed) can be secured to the front-rear stretchers 16 and/or to the lateral stretchers 12 in any manner desired, such as by a relatively close or tight fit as illustrated in FIG. 18B, and/or in any other manner described herein with reference to the connection between the front-rear stretchers 16 and the secondary uprights 18. In the illustrated preferred embodiment of FIGS. 16-18C, plates 50 are connected to the upper front-rear stretchers 16 by threaded fasteners passing through aligned apertures in the plates 50 and front-rear stretchers 16.

In some preferred embodiments, the secondary front-rear stretchers 16 are retained in desired positions by one or more stabilizer bars 20 connected to and between the secondary front-rear stretchers 16 (see FIGS. 1, 2, 6A, and 6B). The stabilizer bars 20 can take any shape and be of any material such as those described above with reference to the elements of the warehouse-type rack. In the illustrated preferred embodiment, the stabilizer bar 20 is an elongated strip having notched and apertured ends.

Figure 3A:
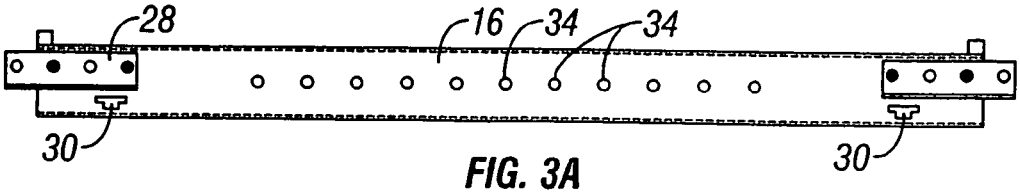
FIGS. 3A-3C are side, top, and end elevational views, respectively, of stretchers illustrated in FIGS. 1 and 2.
Figure 3B:
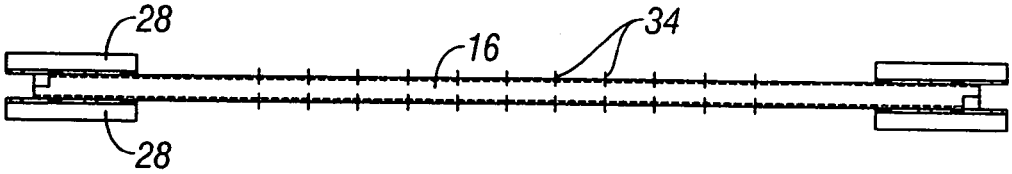
Figure 3C:
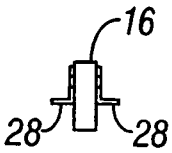

The ends of the stabilizer bar 20 are preferably received within apertures 30 in the sides of the secondary front-rear stretchers 16 (See FIG. 3A). Most preferably, the apertures 30 in the sides of the secondary front-rear stretchers 16 are shaped to interlock with the notched ends of the stabilizer bars 20. A threaded fastener, finger, pin, or other element can be inserted into the apertures 32 in the ends of the stabilizer bars 20 after their insertion into the apertures 30 of the secondary front-rear stretchers 16 in order to retain the connection between the stabilizer bars 20 and the secondary front-rear stretchers 16.

The stabilizer bars 20 can be releasably connected to the secondary front-rear stretchers 16 in a number of other conventional manners, such as by being bolted, clamped, snap-fit, or clipped thereto, by being attached to the secondary front-rear stretchers 16 with pin and aperture connections, and the like. One having ordinary skill in the art will appreciate that still other manners of releasably connecting the stabilizer bars 20 to the secondary front-rear stretchers 16 are possible, each one of which falls within the spirit and scope of the present invention.

In the illustrated preferred embodiment shown in FIGS. 1-9C, two stabilizer bars 20 are connected between adjacent secondary front-rear stretchers 16 as described above: a stabilizer bar 20 at each end of each secondary front-rear stretcher 16. However, it should be noted that any number of stabilizer bars 20 located anywhere along the lengths of the secondary front-rear stretchers 16 can be employed, and can connect the secondary front-rear stretchers 16 at any angle desired.

As described above, the conversion rack assembly of the present invention employs secondary uprights 18 supported by the secondary front-rear stretchers 16. With particular reference to FIGS. 1, 2, 4A, and 4B, the secondary uprights 18 are preferably elongated tubular elements. The secondary uprights 18 can have any cross-sectional shape and can be made of any resilient material, such as those described above with reference to the elements of the warehouse-type rack assembly. Preferably however, the secondary uprights 18 have a rectangular cross-section and extend between secondary front-rear stretchers 16 located in a vertically spaced arrangement with respect to one another—that is, between front-rear stretchers above and below one another.

Figure 4A:
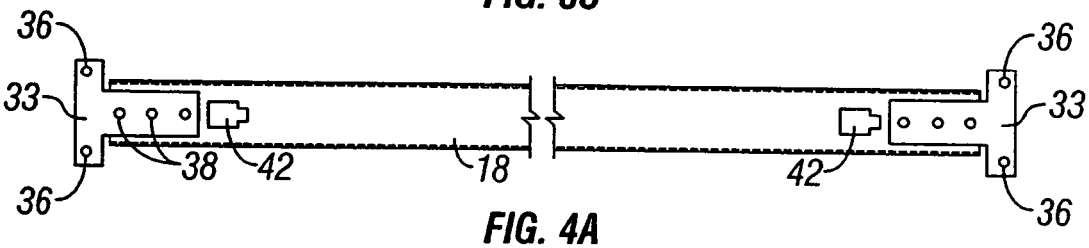
FIGS. 4A and 4B are side and front elevational views, respectively, of an upright illustrated in FIGS. 1 and 2.
Figure 4B:
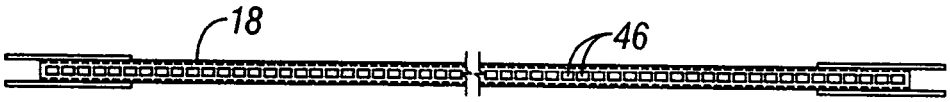
Figure 5:
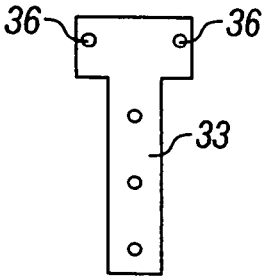
FIG. 5 is a front elevational view of a post plate illustrated in FIGS. 1 and 2.
Figure 6A:
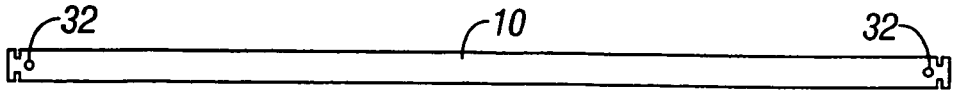
FIGS. 6A and 6B are top and side elevational views, respectively, of a stabilizer illustrated in FIGS. 1 and 2.
Figure 6B:
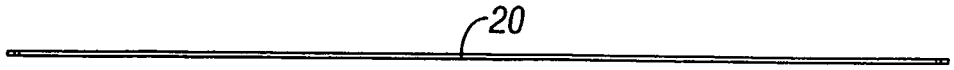
Figure 7A:
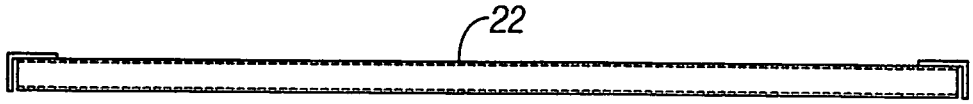
FIGS. 7A and 7B are side and end elevational views, respectively, of a support spacer illustrated in FIGS. 1 and 2.
Figure 7B:
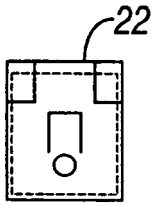

The ends of the secondary uprights 18 are preferably connected to the secondary front-rear stretchers 16 by a number of plates 33 (see FIG. 4A, 4B, and 5). The plates 33 can be integral with or permanently connected to either or both the secondary uprights 18 and the secondary front-rear stretchers 16, such as by welding, brazing, riveting, and the like. However, the plates 33 are more preferably releasably connected to the secondary uprights 18 and the secondary front-rear stretchers 16, such as by one or more threaded fasteners, one or more conventional clamps, or pins, posts, or fingers received in apertures in the secondary uprights 18 and/or secondary front-rear stretchers 16, and the like. One having ordinary skill in the art will appreciate that still other manners of permanently and releasably connecting the plates 33 to the secondary uprights 18 and to the secondary front-rear stretchers 16 exist, each of which falls within the spirit and scope of the present invention.

By their connection to the secondary front-rear stretchers 16 as described herein, the secondary uprights 18 can preferably bear the load of panels or walls 24 directly or indirectly connected to the secondary uprights 18 (described in more detail below), merchandise display and storage elements connected to the panels or walls 24 or otherwise directly or indirectly connected to the secondary uprights 18, and merchandise supported by such elements. The connections of the secondary uprights 18 to upper and lower secondary front-rear stretchers 16 are both preferably capable of bearing such loads. As a result, these loads are preferably not only supported from below by the lower front-rear stretchers 16, but also from above by the upper secondary front-rear stretchers 16. The preferred load-bearing connections between the secondary uprights 18 and the upper and lower secondary front-rear stretchers 16 therefore result in an increased load-bearing capacity of the conversion rack apparatus of the present invention. In other embodiments where only one of the connections between the secondary uprights 18 and the secondary front-rear stretchers 16 is capable of bearing significant load, the conversion rack apparatus may have a reduced load-bearing capacity. In some cases where a relatively large load-bearing capacity of the secondary uprights 18 is not needed, one of the ends of each secondary upright 18 need not necessarily be connected to a secondary front-rear stretcher 16.

Any number of plates 33 can be used to connect the end of a secondary upright 18 to a secondary front-rear stretcher 16. In the illustrated preferred embodiment, two plates 33 flanking the ends of each secondary upright 18 and flanking the secondary front-rear stretcher 16 are preferably employed. In other embodiments, one, three, or even more plates 33 can be used as desired.

The plates 33 function to create a reinforced joint between the secondary uprights 18 and the secondary front-rear stretchers 16. A releasable connection between the secondary uprights 18 and the secondary front-rear stretchers 16 (enabled, for example, by a releasable connection of the plates 33 to either or both of these elements) provides the conversion rack assembly of the present invention with significantly increased versatility for the arrangement of other components such as shelving and the like.

With regard first to the releasable connection and adjustability of the plates 33 on the secondary front-rear stretchers 16, this feature enables the secondary uprights 18 to be connected at multiple points along the length of the secondary front-rear stretchers 16 and thereby permits a user to select the desired depth of the merchandise storage and display area of the conversion rack assembly.

The plates 33 can be adjustably secured in multiple locations on the secondary front-rear stretchers 16 in a number of different manners. Most preferably, the secondary front-rear stretchers 16 have multiple apertures 34 along their lengths (see FIGS. 3A and 3B) to which the plates 33 can be connected by passing threaded fasteners, pins, rods, or other elements through the apertures 34 and through aligned apertures 36 in the plates 33. Other manners of connecting the plates 33 to the secondary front-rear stretchers 16 at different points along the secondary front-rear stretchers 16 include a releasable clamp on the plates 33 that can be tightened to releasably secure the secondary uprights 18 in place on the secondary front-rear stretchers 16, multiple detents along the secondary front-rear stretchers 16 into which a ratchet, spring-loaded pin, tooth, ball, or other element can be received, and the like. Still other manners of such releasable and adjustable connection along the secondary front-rear stretchers 16 are possible and would be appreciated by one having ordinary skill in the art.

Similarly, the plates 33 on either or both ends of the secondary uprights 18 are preferably releasably and adjustably connected to the secondary uprights 18 as mentioned above. This feature permits a user to adjust the location of the plates 33 with respect to the secondary uprights 18 in order to adjust for and accommodate variations in the vertical spacing (or height) between lateral stretchers 12 of the warehouse-type rack in which the conversion rack of the present invention is installed. If a particular vertical distance (or height) is desired between such lateral stretchers 12, adjustment of the plates 33 on the secondary vertical uprights 18 is an attractive and time-saving alternative to disconnecting, moving, and reconnecting the lateral stretchers 12 to different vertical positions in the warehouse-type rack. Preferably, the plates 33 at either or both ends of the secondary uprights 18 are provided with slotted apertures 38 (see FIG. 4A), permitting a user to loosen threaded fasteners received therein, re-position the plates 33 to different vertical positions on the secondary uprights 18, and tighten the threaded fasteners to secure the plates 33 in the different vertical positions.

Figure 2:
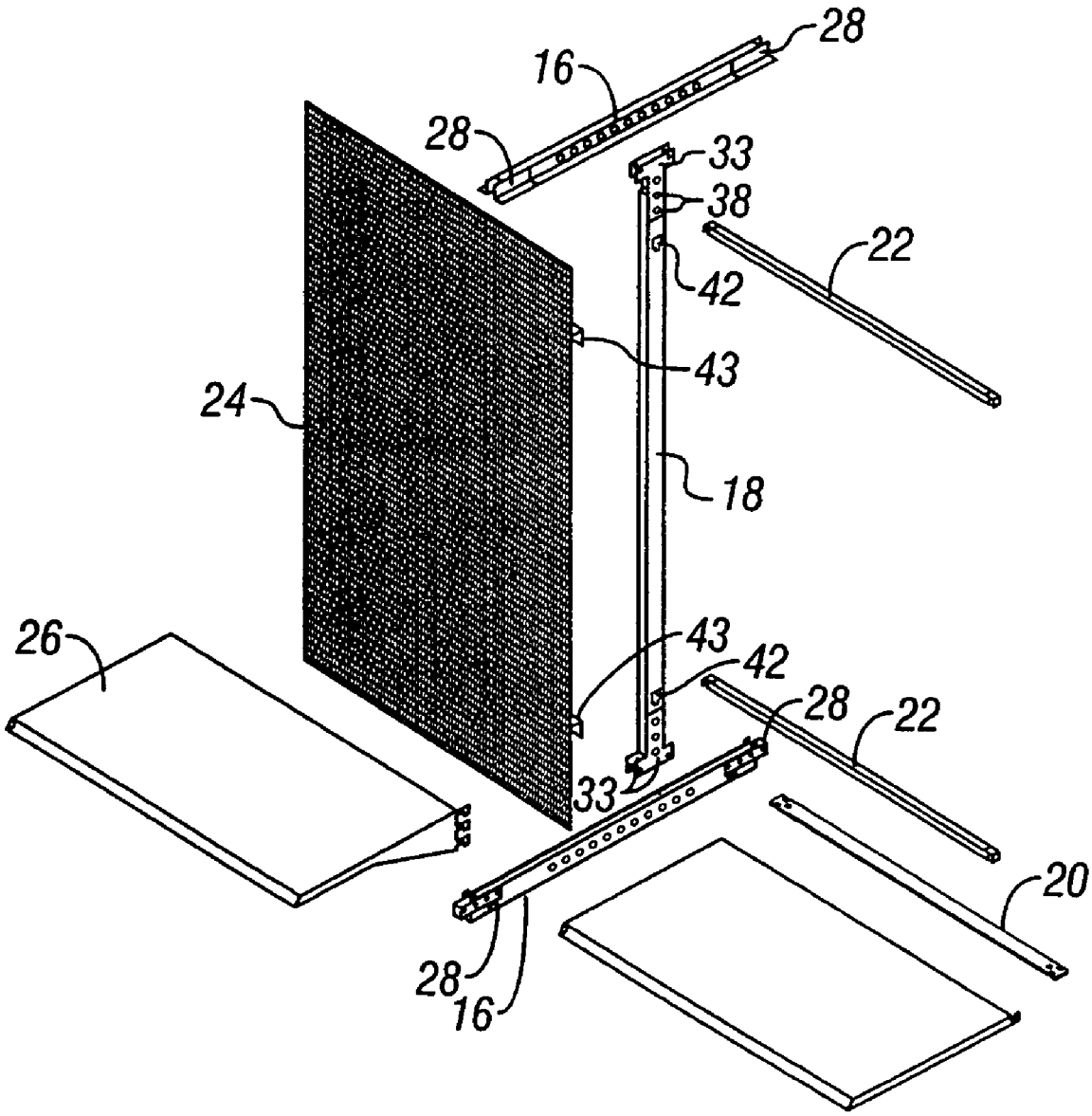
FIG. 2 is an exploded perspective view of various elements of the rack assembly illustrated in FIG. 1.

With continued reference to FIGS. 1 and 2, it should be noted that the manner in which the secondary uprights 18 are connected to the secondary front-rear stretchers 16 in the illustrated preferred embodiment is only one example of a number of different connection types that can be employed in the present invention. The secondary uprights 18 can be connected to the secondary front-rear stretchers 16 in other manners, such as by being integrally formed therewith or permanently connected thereto (e.g., by welding, brazing, riveting, and the like). In other embodiments, alternative releasable connections of the secondary uprights 18 to the secondary front-rear stretchers 16 are possible. By way of example only, the secondary uprights 18 can have ends that are shaped to be received within apertures 40, sockets, or other receptacles in the secondary front-rear stretchers 16 (as shown in FIGS. 10-12B of the second preferred embodiment), can have threaded ends received within threaded apertures in the secondary front-rear stretchers 16, can be received within collars or between supports connected in any conventional manner to the top or sides of the secondary front-rear stretchers 16, can be bolted, pinned, clamped, clipped, or secured with one or more conventional fasteners in any other manner to the secondary front-rear stretchers 16, and the like.

The manner in which the secondary uprights 18 can be adjustably positioned with respect to the secondary front-rear stretchers 16 at least partially depends upon the type of connection employed between these elements. For example, in a releasable pinned or bolted connection (using aligned apertures in the plates 33 and the secondary uprights 18 and/or the secondary front-rear stretchers 16 as described above), multiple apertures along the lengths of the secondary front-rear stretchers 16 and/or the secondary uprights 18 are preferred as described above. However, where the ends of the secondary uprights 18 are received within apertures 40 in the secondary front-rear stretchers 16, multiple apertures 40 running along the secondary front-rear stretchers 16 are preferred. In still other embodiments employing other conventional fasteners such as clamps, some fasteners can be secured in an infinite or nearly-infinite range of positions on the secondary front-rear stretchers 16 or the secondary uprights 18. All such manners of releasably and adjustably connecting the secondary uprights 18 to the secondary front-rear stretchers 16 are considered to be encompassed by the present invention.

To increase the structural strength and stability of the conversion rack apparatus of the present invention and to provide more options for connecting merchandise display and storage elements within the conversion rack apparatus, optional support spacers 22 (FIGS. 1 and 2) can be connected to and between adjacent secondary uprights 18. The support spacers 22 can also provide additional support for bearing the load of panels or walls 24 of the conversion rack apparatus, merchandise display and storage elements connected to the panels or walls 24 or otherwise directly or indirectly connected to the support spacers 22, and merchandise supported by such elements. The support spacers 22 can be substantially flat elements such as the preferred stabilizer bars 20, tubular elements such as the preferred secondary front-rear stretchers 16, elements having a channel or angle-shaped cross-section, or elements having any other hollow or solid cross-sectional shape desired. In addition, the support spacers 22 can be made of any resilient material such as those described above with reference to the elements of the warehouse-type rack.

The ends of the support spacers 22 are preferably connected to adjacent secondary uprights 18 by being received within apertures 42 in the secondary uprights 18 as best shown in FIGS. 1 and 2. Any aperture shape and cooperating support spacer end shape capable of retaining the ends of the support spacer 22 can be used. In some highly preferred embodiments such as that shown in FIGS. 1 and 2, the apertures 42 are keyhole shaped and receive turned flanged ends of the support spacers 22. In other embodiments such as that shown in FIG. 10, the apertures 42 in the secondary uprights 18 receive one or more pins or posts (headed or otherwise), fingers, or other protrusions extending from or integral with the ends of the support spacers 22. In still other embodiments, the ends of the support spacers 22 are connected to the secondary uprights 18 using conventional fasteners, inter-engaging elements, or any of the connection methods described above with reference to the connections between the secondary uprights 18 and the secondary front-rear stretchers 16.

In some preferred embodiments, the support spacers 22 are adjustably connected to the secondary uprights 18 and so can be connected at different locations along the height of the secondary uprights 18. By way of example only, the support spacers 22 can be connected to any of the apertures. 42 (at a number of different heights) on the secondary uprights 18 in the second preferred embodiment illustrated in FIG. 10. In other embodiments, the connection location of the support spacers 22 on the secondary uprights 18 is adjustable in any of the manners described above with reference to the preferred connection adjustability of the secondary uprights 18 to the secondary front-rear stretchers 16.

The secondary front-rear stretchers 16, secondary uprights 18, stabilizer bars 20 (if used), and support spacers 22 (if used) represent the framework of the conversion rack assembly upon which any number of different merchandise display and storage elements or fixtures can be mounted, preferably in a wide range of depths, heights, and lateral positions in a warehouse-type rack assembly. Although a wide variety of conventional merchandise display and storage elements and fixtures can be mounted on this framework (such as baskets, shelves, hangers, posts, panels, walls, etc.), only two will be described herein for purposes of illustration.

Figure 15A:
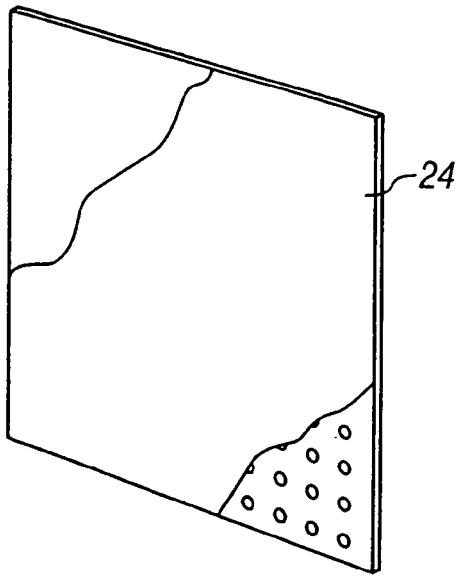
FIGS. 15A and 15B are perspective views of two types of panels used in conjunction with the rack assembly illustrated in FIG. 10.
Figure 15B:
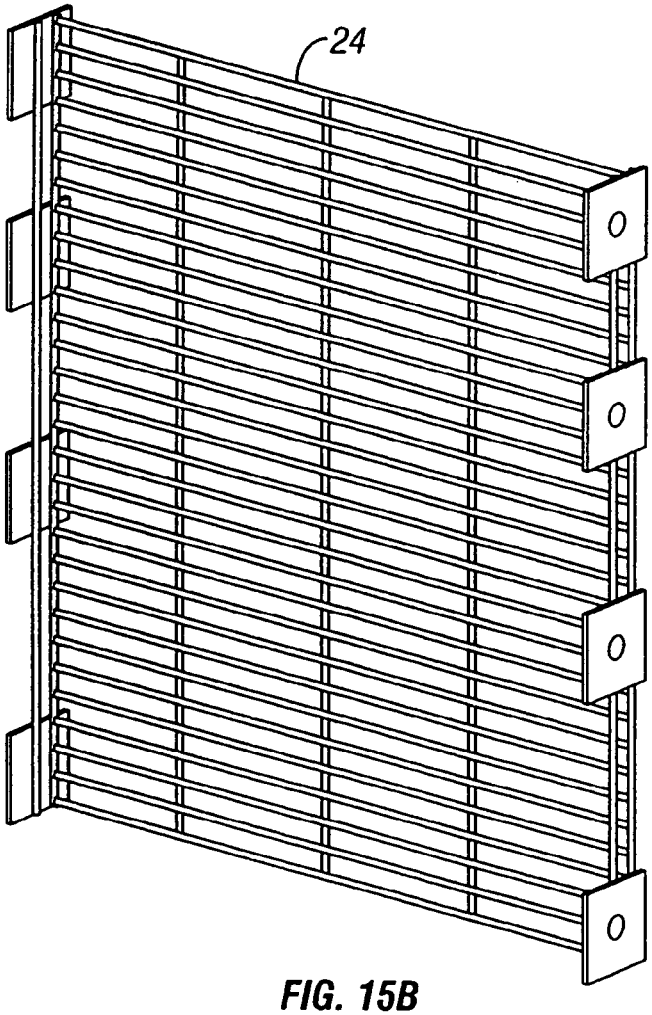

Panels or walls 24 can be connected to the conversion rack assembly by being connected to one or more support spacers 22, by being connected to one or more secondary uprights 18, and/or by being connected to one or more secondary front-rear stretchers 16. An example of panels or walls being connected to support spacers 22 is illustrated in FIGS. 1 and 2. In this embodiment, the panel 24 is an expanded metal sheet having brackets 43 connected thereto in any conventional manner (e.g., by welding, threaded fasteners, wire, and the like). The brackets 43 preferably engage with the support spacers 22 to at least partially support the panel 24 upon the support spacers 22. Alternatively, the panels 24 could be fastened directly to the support spacers 22, such as by bolts passing through the panels 24 and into apertures in the support spacers 22. In other embodiments, the tops and/or bottoms of the panels 24 can be received within channels defined by the support spacers 22 (see FIG. 10). Still other manners of mounting panels or walls 24 within the conversion rack assembly are possible and would be appreciated by one having ordinary skill in the art. As illustrated in FIGS. 15A and 15B, the panels or walls 24 can take any form desired, including without limitation solid or apertured plates, expanded metal, mesh, corrugated or shaped panels, peg-board, welded wire grid, and the like.

Figure 10:
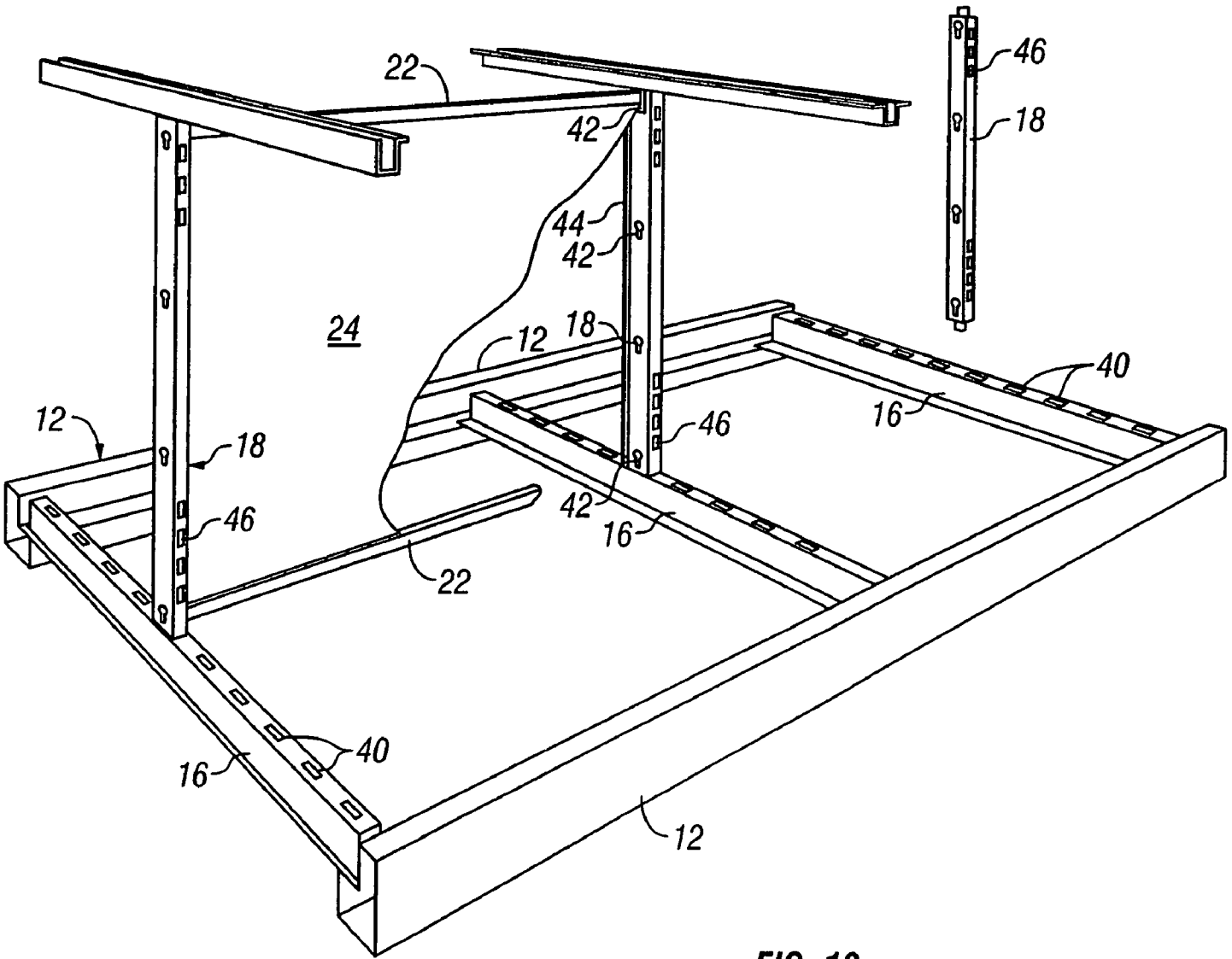
FIG. 10 is a perspective view of a rack assembly, partially assembled, according to a second preferred embodiment of the present invention.
Figure 11A:
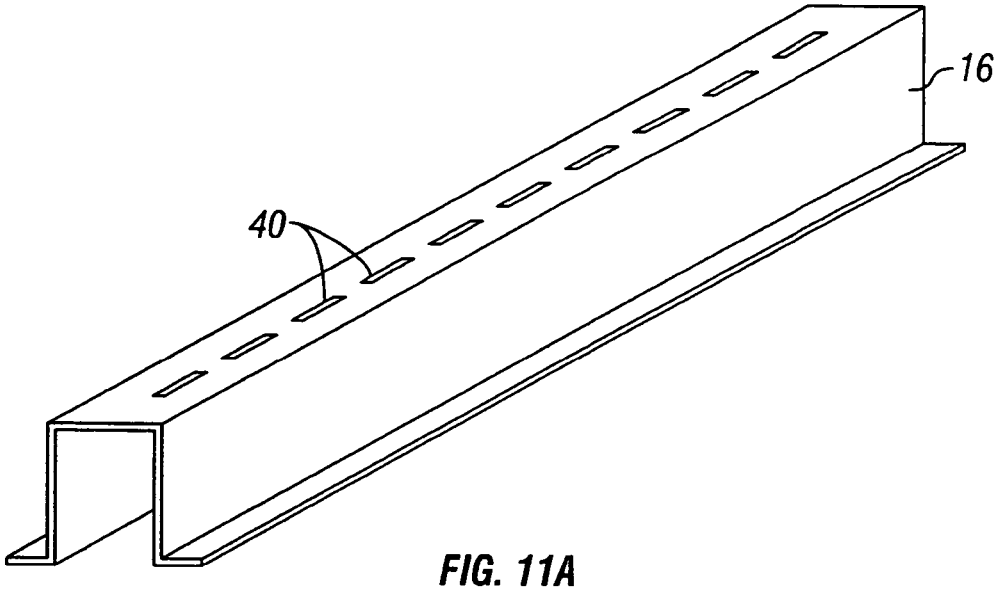
FIGS. 11A-11D are perspective, top, side, and end views of a stretcher illustrated in FIG. 10.
Figure 11B:
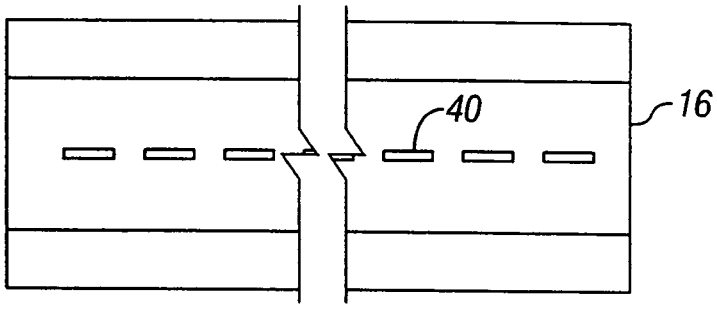
Figure 11C:
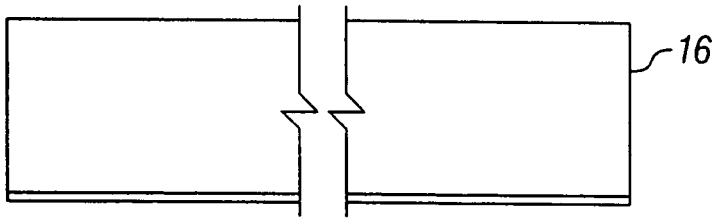
Figure 11D:
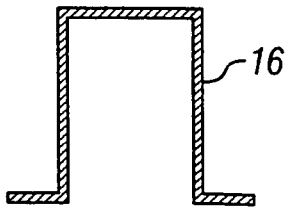
Figure 12A:
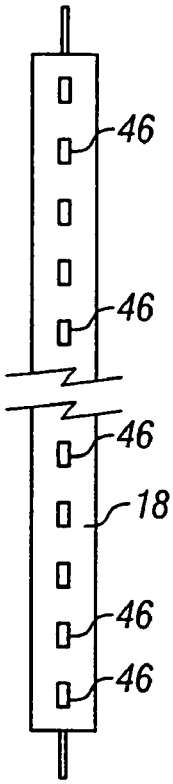
FIGS. 12A and 12B are front and side elevational views of an upright illustrated in FIG. 10.
Figure 12B:
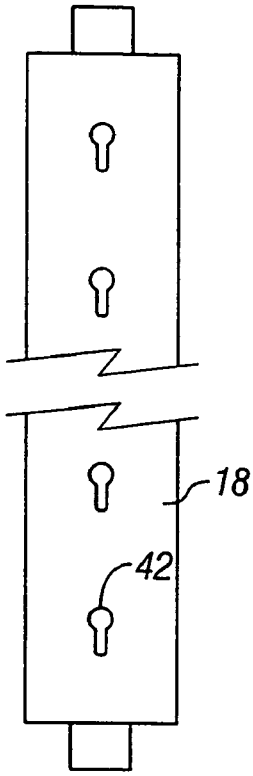
Figure 13A:
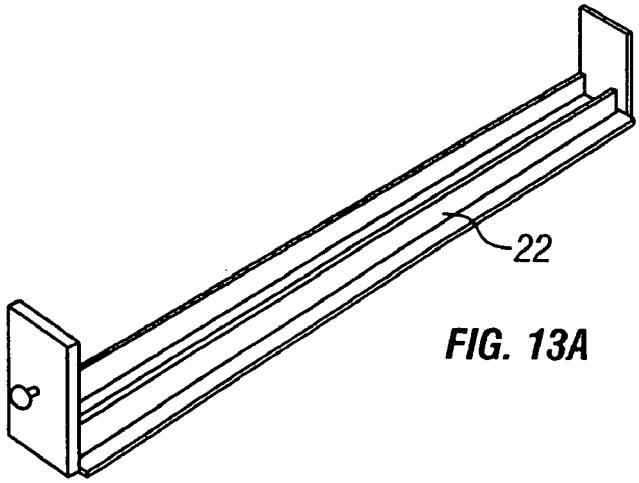
FIGS. 13A-13C are perspective, side, and cross-sectional views of a panel retainer illustrated in FIG. 10.
Figure 13B:
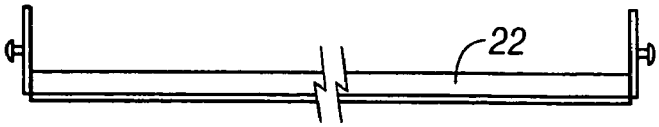
Figure 13C:
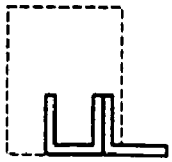
Figure 14A:
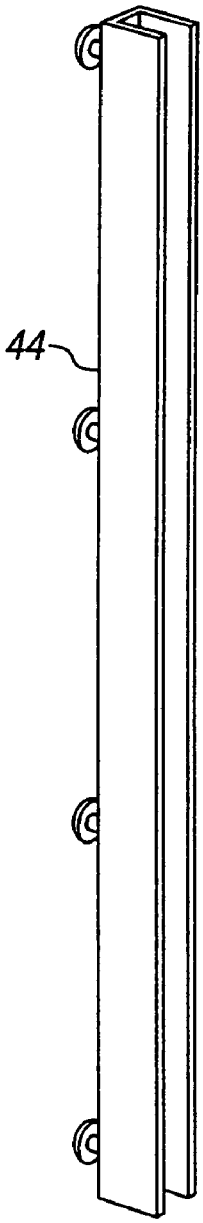
FIGS. 14A and 14B are rear perspective and side views of another panel retainer illustrated in FIG. 10.
Figure 14B:
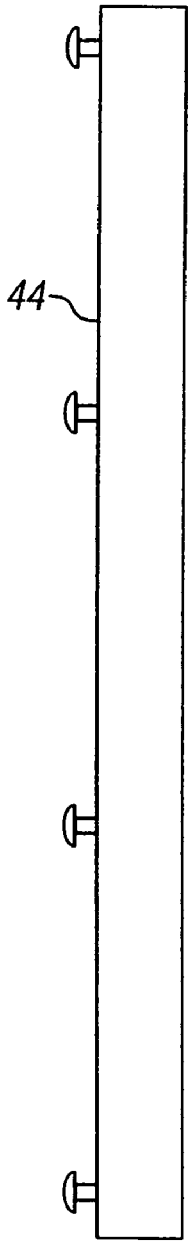

An example of panels or walls 24 being connected to secondary uprights 18 is also illustrated in FIG. 10. In this embodiment, the panels or walls 24 are received within channels 44 connected to the secondary uprights 18. The channels 44 (see FIGS. 14A and 14B) can be defined by flanges of the secondary uprights 18 or can be connected to the secondary uprights 18 in any of the manners described above with reference to the connection of the support spacers 22 to the secondary uprights 18. In the illustrated preferred embodiment of FIG. 10, the channels 44 are connected to the secondary uprights 18 by headed posts on the channels 44 received within apertures 42 in the secondary uprights 18 (or vice versa). Alternatively, the panels or walls 24 can be provided with pins, posts, fingers, or other protrusions received within the secondary upright apertures 42 (see FIG. 15B). In still other embodiments, the panels or walls 24 can be fastened to the secondary uprights 18 in a manner similar to that described above with reference to the connections between the panels or walls 24 and the support spacers 22.

Figure 22:
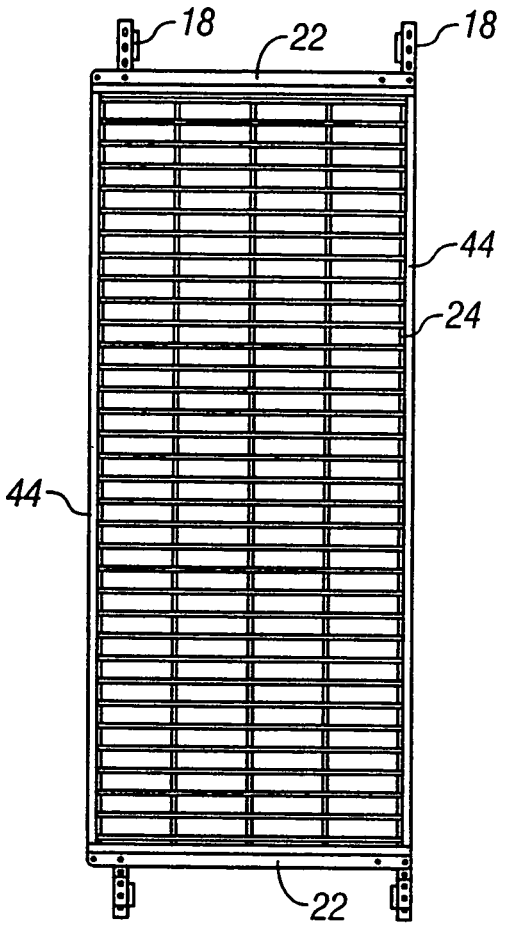
FIG. 22 is a front elevational view of a wall sub-assembly according to a preferred embodiment of the present invention, shown installed on secondary uprights.
Figure 23:
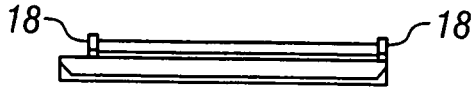
FIG. 23 is a top view of the wall assembly and secondary uprights illustrated in FIG. 22.
Figure 24:
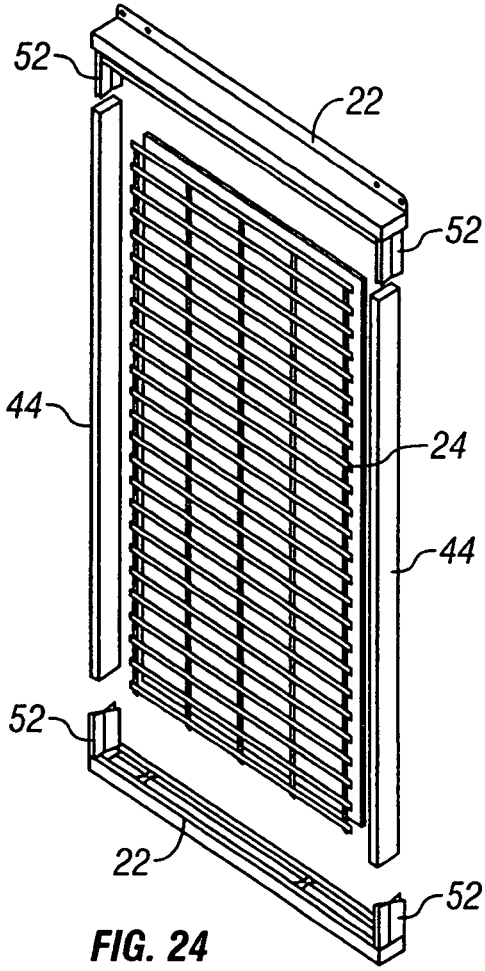
FIG. 24 is an exploded perspective view of the wall assembly illustrated in FIG. 22.

Another manner in which to secure panels or walls 24 within the rack assembly of the present invention is illustrated in FIGS. 22-24. Specifically, FIGS. 22-24 provide another example of how a panel or wall 24 can be connected to secondary uprights 18. In this embodiment, the panel or wall 24 is secured to the secondary uprights 18 using the same connection features or elements to which shelves and other merchandise display and storage elements are connected.

With continued reference to FIGS. 22-24, a wire rack panel 24 is preferably received within a frame defined by vertical channels 44 and horizontal support spacers 22. The vertical channels 44 and horizontal support spacers 22 can be connected in any conventional manner, and in the illustrated preferred embodiment are connected together by inserts 52 (described in greater detail below) extending from the support spacers 22 into the ends of the vertical channels 44. Alternatively, the vertical channels 44 can be connected to the support spacers 22 by welds, brazing, other inter-engaging elements, bolts, screws, nails, pins, posts, clips, clamps, and other conventional fasteners, and the like.

The support spacers 22 and/or the vertical channels 44 are preferably secured to the secondary uprights in any of the manners just described for connecting the support spacers 22 to the vertical channels 44. More preferably however, conventional fasteners such as bolts, screws, or pins are inserted through apertures in the support spacers 22 and/or the vertical channels 44 aligned with apertures in the secondary uprights 18. In some highly preferred embodiments, multiple apertures in the support spacers 22 and in the vertical channels 44 permit the panel or wall 24 to be secured in different locations on the secondary uprights 18 as desired. For example, the wall 24 illustrated in FIGS. 22 and 23 is attached to the secondary uprights 18 in an off-center position to demonstrate this mounting versatility.

One having ordinary skill in the art will appreciate that a wall or panel 24 can be mounted to any number of secondary uprights 18 in a number of different manners, only some of which employ channels 44, laterally-extending support spacers 22, and other frame-type elements. Any other manner of directly or indirectly connecting a wall or panel 24 to the secondary uprights 18 can instead be employed as desired.

Because in some embodiments the secondary spacers 22 can be connected to the secondary uprights 18 at different heights and because the secondary uprights 18 permit connection of other elements thereto at different heights, the location of panels and other merchandise display and storage elements and fixtures can be further adjusted as desired by the user to provide a wide range of configurations to meet the needs or requirements of any number of retail environments.

Figure 8A:
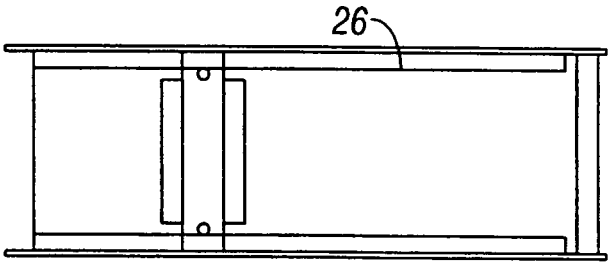
FIGS. 8A-8E are top and side elevational views of shelves used in conjunction with the rack assembly illustrated in FIGS. 1 and 2.
Figure 8B:
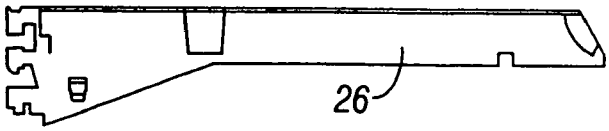
Figure 8C:
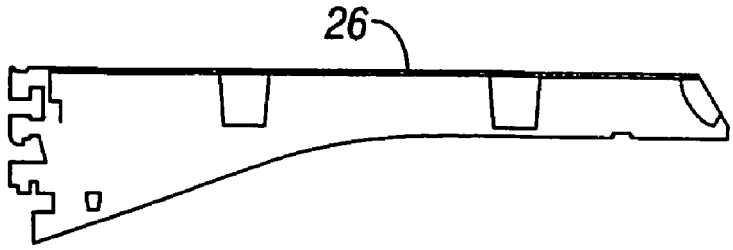
Figure 8D:
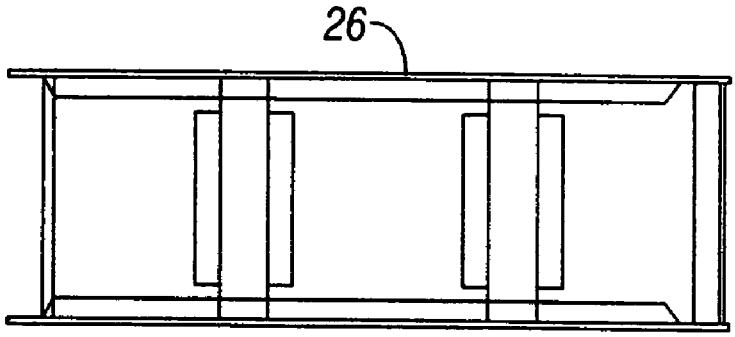
Figure 8E:
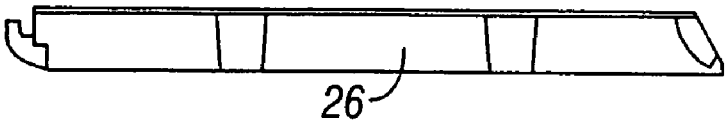
Figure 9A:
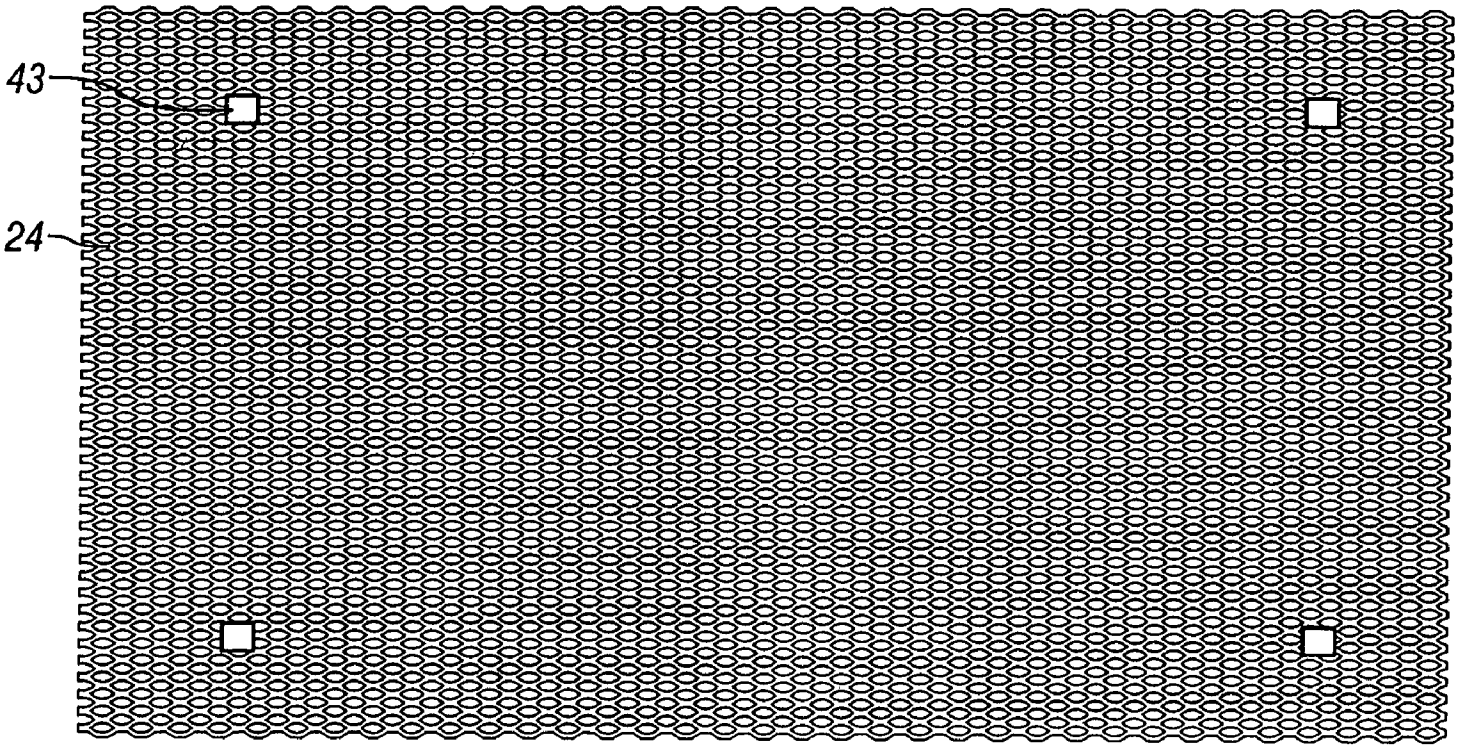
FIGS. 9A-9C are front elevational and two detailed views of the panel illustrated in FIGS. 1 and 2.
Figure 9B:
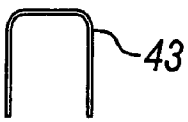
Figure 9C:
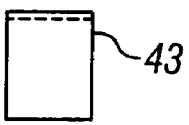

Another example of merchandising display and storage elements that can be used in conjunction with the present invention is shelving. With reference to FIGS. 8A-8E which show examples of shelves that can be connected to the conversion rack assembly of the present invention, shelving can be connected to the secondary uprights 18 or to panels or walls 24 which are connected to the secondary uprights 18. In the illustrated preferred embodiment, the shelves 26 can have one or more teeth, fingers, or other protrusions which can mate with apertures 46 in the secondary uprights 18 or panels or walls 24. Such shelving connections and alternatives thereto are well known to those skilled in the art and are not therefore described further herein. However, for purposes of adjustability, the secondary uprights 18 and/or the panels or walls 24 preferably have multiple apertures along their lengths to enable a wide range of positions in which the shelves 26 can be connected as desired. With reference to FIG. 1 and FIG. 8E, it should be noted that some shelves 26 can be adapted to permit installation in particular locations in the warehouse-type rack, such as the bottom shelf illustrated in FIG. 8E adapted for installation in a limited number of secondary upright apertures 46 and not requiring support from the lateral stretchers 12 of the warehouse-type rack. In addition, the lateral adjustability of the secondary uprights 18 enables the use of any number of different lengths of shelves and fixtures, contributing to the versatility of the conversion rack assembly. Thus, shelving and other types of retail display and storage fixtures can be arranged vertically and laterally in just about any desired configuration to meet the needs of different retail and storage environments.

Still other merchandising display and storage elements can be mounted in the conversion rack assembly of the present invention. Most preferably, these merchandise display and storage elements can be adjustably mounted as described above in a range of lateral, depth, and height positions in the warehouse-type rack, thereby providing existing warehouse-type racks with significantly increased flexibility and adaptability.

The various features and structures of the present invention as described above can be employed in any combination desired to result in rack assemblies having different degrees of simplicity, adjustability, and versatility. In the embodiment illustrated in FIG. 16 for example, the rack assembly employs many of the same components described above, including front-rear stretchers 16, secondary uprights 18, and stabilizer bars 20, but employs a different manner of connection between the secondary uprights 18 and the front-rear stretchers 16. Specifically, the secondary uprights 18 have apertures 48 through which the front-rear stretchers 16 extend in order to connect the front-rear stretchers 16 to the secondary uprights 18 (see also FIGS. 17-18C). Although this mating relationship can provide sufficient strength for the rack assembly, the front-rear stretchers 16 and the secondary uprights 18 can be further secured in this relationship in any conventional manner, such as by welds, brazing, adhesive or cohesive bonding material, by one or more screws, bolts, nails, rivets, clips, clamps, pins, and other conventional fasteners, by snap or interference fitting the front-rear stretchers 16 within the secondary uprights 18, and the like.

One having ordinary skill in the art will appreciate that other manners of interconnecting the secondary uprights 18 and the front-rear stretchers 16 can be employed and fall within the spirit and scope of the present invention. For example, the secondary uprights 18 can extend through apertures in the front-rear stretchers 16. Alternatively, the secondary uprights 18 can be received within notches, recesses, or other apertures located in the front-rear stretchers 16 (and vice-versa) defining other types of inter-engagement between these elements. Depending at least partially upon the type of inter-engagement between the secondary uprights 18 and the front-rear stretchers 16, these elements can be adjustable with respect to one another as desired. For example, the front-rear stretchers 16 in the illustrated preferred embodiment of FIGS. 16-18C can be slidable to different positions in the aperture(s) 48 of the secondary uprights 18 to alter the depth of the rack assembly.

With continued reference to the rack assembly illustrated in FIGS. 16-18C, the manner of connection between the front-rear stretchers 16 and the secondary uprights 18 described above can be employed between any connected front-rear stretcher 16 and secondary upright 18. By way of example only, and with reference to the embodiment of the present invention illustrated in FIGS. 16-18C, both upper and lower front-rear stretchers 16 are received through apertures 48 in the secondary uprights 18. In other embodiments, only some of the front-rear stretchers are connected in this manner. The other front-rear stretchers 16 are connected to the secondary uprights 18 in any of the other manners described above with reference to the earlier embodiments.

It should be noted that the same secondary upright 18 can be connected to any number of front-rear stretchers 16. In a two-level rack assembly, each secondary upright 18 can be connected to a top front-rear stretcher 16, a bottom front-rear stretcher 16, and (more preferably) both top and bottom front-rear stretchers 16. In other embodiments, a secondary upright can be connected to three or more front-rear stretchers 16, such as multiple front-rear stretchers 16 extending through apertures 48 at different vertical locations along the secondary upright 18. This ability to connect any desired number of front-rear stretchers 16 to the secondary uprights 18 significantly increases the modularity and versatility of the present invention. In these and other embodiments, the secondary uprights 18 need not terminate at the front-rear stretchers 16 to which they are connected. Instead, the secondary uprights 18 can extend above and/or below such front-rear stretchers 16, in some cases permitting attachment of further support spacers 22, stabilizer bars 20, panels or walls 24, shelves 26, other merchandise display and storage elements, and other structure and elements as desired. By way of example only, the secondary uprights 18 illustrated in FIGS. 16-18C extend vertically above the upper front-rear stretchers 16 for attachment of additional shelves 26 or other elements thereto.

In some embodiments of the present invention, each of the secondary front-rear stretchers 16 extend between and are supported by lateral stretchers 12 of a warehouse-type rack. However, it should be noted that not all front-rear stretchers 16 need to have this relationship with the warehouse rack lateral stretchers 12. In some cases, less than all of the front-rear stretchers 16 are supported by the warehouse rack lateral stretchers 12.

Figure 16:
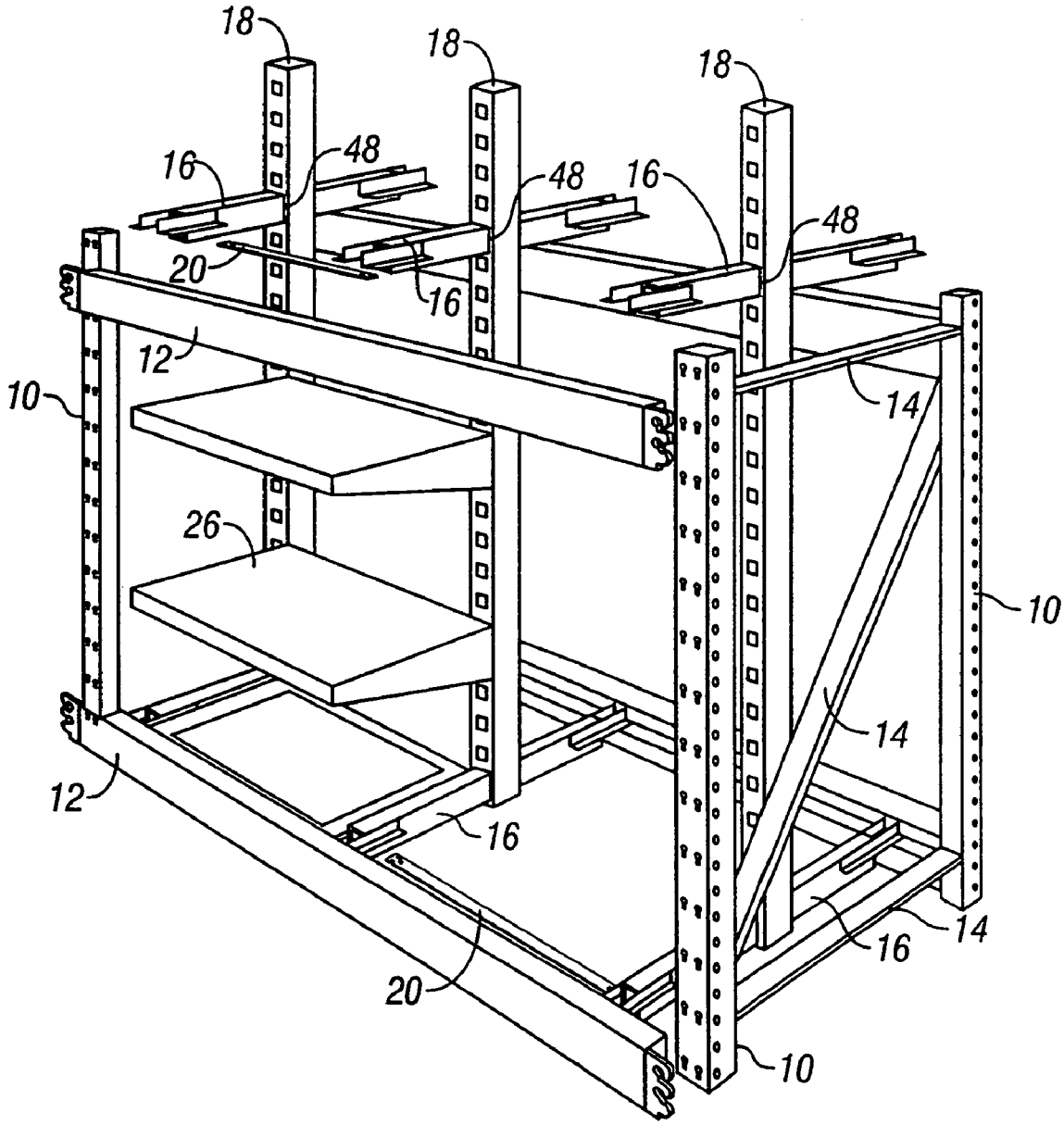
FIG. 16 is an exploded perspective view of a rack assembly, partially assembled, according to a third preferred embodiment of the present invention.
Figure 17:
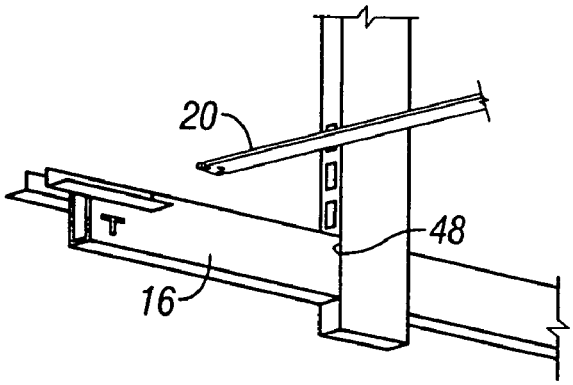
FIG. 17 is a perspective detail view of the rack assembly illustrated in FIG. 16.

For example, the upper front-rear stretchers 16 in the embodiment illustrated in FIG. 16 are located above the upper lateral stretchers 12 of the warehouse rack, and are sufficiently supported by the secondary uprights 18 to support a load placed upon the upper front-rear stretchers 16 without additional support. This type of relationship between front-rear stretchers 16 and secondary uprights 18 enables an assembler to locate front-rear stretchers 16 (and therefore, shelves 26 and other components supported thereby) in different locations along the secondary uprights 18 independent of the location of the warehouse rack lateral stretchers 12, thereby further increasing the versatility of the present invention. In this regard, multiple apertures 48 in the illustrated preferred embodiment of FIGS. 16-18C can be provided in the secondary uprights 18 for connection of secondary front-rear stretchers 16 at two or more different heights in the warehouse rack. Similar versatility is available in embodiments where the secondary uprights 18 are connected to the secondary front-rear stretchers 16 in any of the other manners described herein.

In those embodiments of the present invention in which less than all of the secondary front-rear stretchers 16 are directly supported by lateral stretchers 12 of the warehouse rack, the load carried by secondary front-rear stretchers 16 not supported in this manner is preferably carried by one or more other secondary front-rear stretchers 16 on the same secondary uprights 18. For example, and with continued reference to FIG. 16, the upper secondary front-rear stretchers 16 are supported by the secondary uprights 18, which are in turn supported by the lower secondary front-rear stretchers 16 on the lower warehouse rack lateral stretchers 12. Subject to the load-bearing capacity of the secondary front-rear stretchers 16 and the lateral stretchers 12 of the warehouse rack, any number of secondary front-rear stretchers 16 can be supported in this manner as desired. Additionally, secondary front-rear stretchers 16 that are not directly supported by warehouse rack lateral stretchers 12 can be supported from above and/or below by other front-rear stretchers 16 on the same secondary uprights 18.

Although a number of embodiments of the present invention employ secondary front-rear stretchers 16 that extend between and rest upon lateral stretchers 12 of a warehouse-type rack as described above and illustrated in the figures, the secondary front-rear stretchers 16 can also or instead be directly supported by the uprights 10 and/or the front-rear stretchers 14 of the warehouse-type rack. In this regard, the secondary front-rear stretchers 16 in some alternative embodiments can be connected to the uprights 10 and/or the front-rear stretchers 14.

Figure 19:
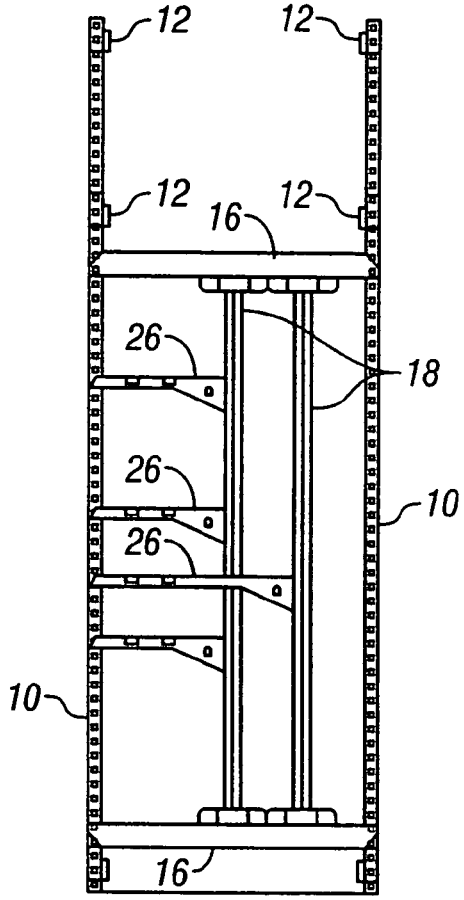
FIG. 19 is a side elevational view of a rack assembly according to a fourth preferred embodiment of the present invention.
Figure 20:
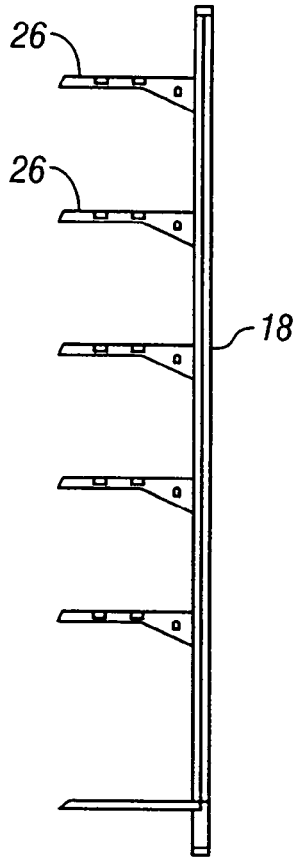
FIG. 20 is a side elevational view of a sub-assembly of the rack assembly illustrated in FIG. 19.
Figure 21:
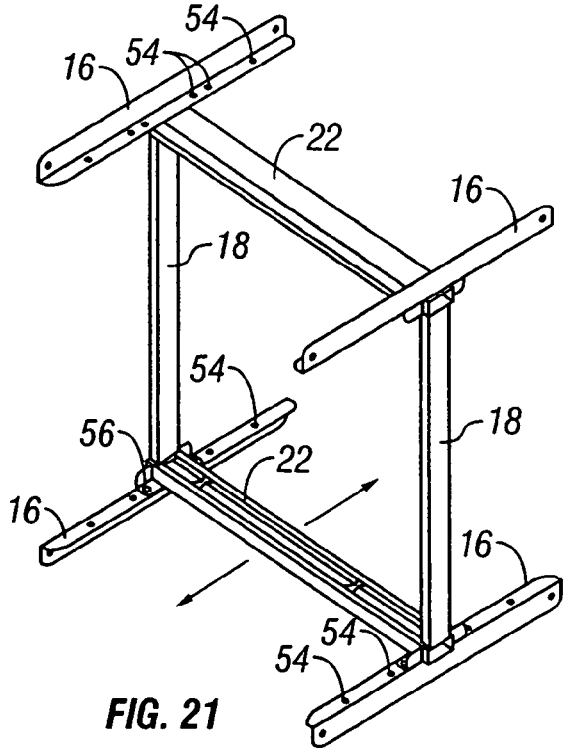
FIG. 21 is a perspective view of a sub-assembly of the rack assembly illustrated in FIG. 19.

An example of such an embodiment is illustrated in FIGS. 19-21. In this embodiment, the front-rear stretchers 16 are preferably connected directly to the uprights 10 of a warehouse-type rack. The front-rear stretchers 16 are generally L-shaped as best shown in FIG. 21, but can instead take any of the other shapes described above with reference to the other embodiments of the present invention. The front-rear stretchers 16 are preferably connected at desired vertical positions on the uprights 10 by conventional fasteners passed through apertures in the front-rear stretchers 16 and the uprights 10. However, depending at least partially upon the type of uprights 10 employed, the front-rear stretchers 16 can be connected to the uprights 10 in any other manner, including the manners of connection described above with reference to the connection between the front-rear stretchers 16 and the secondary uprights 18. In some highly preferred embodiments, pins or headed posts on the front-rear stretchers 16 are received within apertures in the uprights 10 of the warehouse-type rack (or vice versa). Preferably, the pins, headed posts, or other fasteners extend laterally into the apertures in the uprights 10 (or vice versa), although other manners of establishing such connections are possible, connections to the front or rear faces of the uprights 10, the outside faces of the uprights 10, and the like.

In some applications, significant advantages can be achieved by attaching secondary front-rear stretchers 16 to the uprights 10 as described above. With continued reference to FIGS. 19-21 for example, the secondary front-rear stretchers 16 can preferably be connected at different vertical locations along the uprights 10. This enables a user to install the modular rack conversion assembly according to such embodiments at different vertical locations in a warehouse rack independently of the locations of the lateral stretchers 12 of the warehouse rack. In this regard, the secondary front-rear stretchers 16 do not need to rest upon and be supported by the lateral stretchers 12 of the warehouse rack. Accordingly, such embodiments of the present invention can provide a significantly greater degree of flexibility with regard to the location of the present invention installed within a warehouse rack. In some embodiments, assemblies according to the present invention can be installed at a number of different heights within the warehouse rack, and can even be located one above another in the same section of a warehouse rack.

Another advantage provided by embodiments of the present invention such as that illustrated in FIGS. 19-21 is the ability to adapt the assembly to accept connection of standardized rack components (e.g., shelves). By way of example only, in some applications such standardized rack components are dimensioned to be received within and between warehouse rack uprights spaced a standardized distance apart (which can be defined by the lengths of the lateral stretchers 12). In order to connect such rack components to the assembly of the present invention, the secondary uprights 18 can be at least partially located between the planes defined by the inboard and outboard faces of the warehouse rack uprights 10. In this manner, shelves and other rack components having standard sizes can still be readily connected to the assembly of the present invention without modification to the assembly, the components, or the warehouse rack. Although not required, the secondary spacers 22 in such embodiments can extend laterally beyond the secondary front-rear stretchers 16 as shown in FIG. 21 (particularly in cases where such secondary spacers 22 have standardized dimensions that are longer than the distance between the outer faces of the secondary front-rear stretchers 16).

The embodiment of the present invention shown in FIGS. 19-21 provides an example of an alternative manner in which the secondary uprights 18 can be connected to the secondary front-rear stretchers 16 as described above. In the embodiment of FIGS. 19-21, a frame is defined by secondary uprights 18 and support spacers 22. More specifically, the bottom and top of each secondary upright 18 is connected to a support spacer 22 extending between and connected to adjacent secondary front-rear stretchers 16. The secondary uprights 18 are preferably connected to the support spacers 22 by receiving inserts 52 extending from the support spacers 22 into the ends of the secondary uprights 18 (see FIG. 25). The inserts 52 are preferably flanged members secured to the support spacers 22 by being welds, brazing, adhesive or cohesive bonding material, and the like. In some embodiments, the inserts 52 can be connected to the support spacers 22 in any other manner (such as by conventional fasteners, snap-fitting, inter-engaging elements, and the like) and can even be integral with the support spacers. Alternatively, inserts 52 can be secured to or integral with the secondary uprights 18 and can extend into mating engagement with apertures in the support spacers 22. For example, inserts 52 can extend from the secondary uprights 18 into the ends of the support spacers 22.

Whether the inserts 52 (if employed) extend into the secondary uprights 18 and/or the support spacers 22, the inserts 52 can snugly fit into their mating apertures for a secure connection between the secondary uprights 18 and the support spacers 22. If desired, these elements can be further secured together by fasteners, welds, brazing, adhesive or cohesive bonding material, or in any other manner.

The rack assembly embodiment illustrated in FIGS. 19-21 employs inserts 52 to connect secondary uprights 18 to support spacers 22. Although highly preferred, this manner of connection can be substituted for any of those described above with reference to the connection between the secondary uprights 18 and the support spacers 22 in the embodiment illustrated in FIGS. 1-9C. An attractive feature provided by the type of connection illustrated in FIG. 21 is the ability to quickly and easily assemble the rack assembly and a frame for a panel or wall 24 defined at least in part by the secondary uprights 18 and the support spacers 22.

Figure 25:
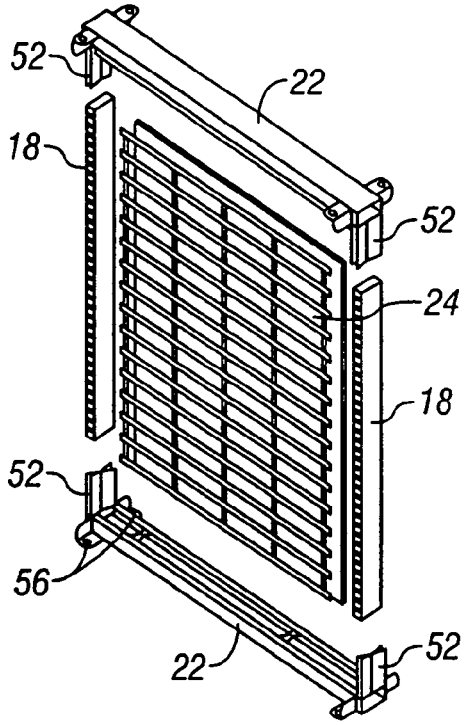
FIG. 25 is an exploded perspective view of a single panel section of the wall assembly illustrated in FIG. 19.
Figure 26:
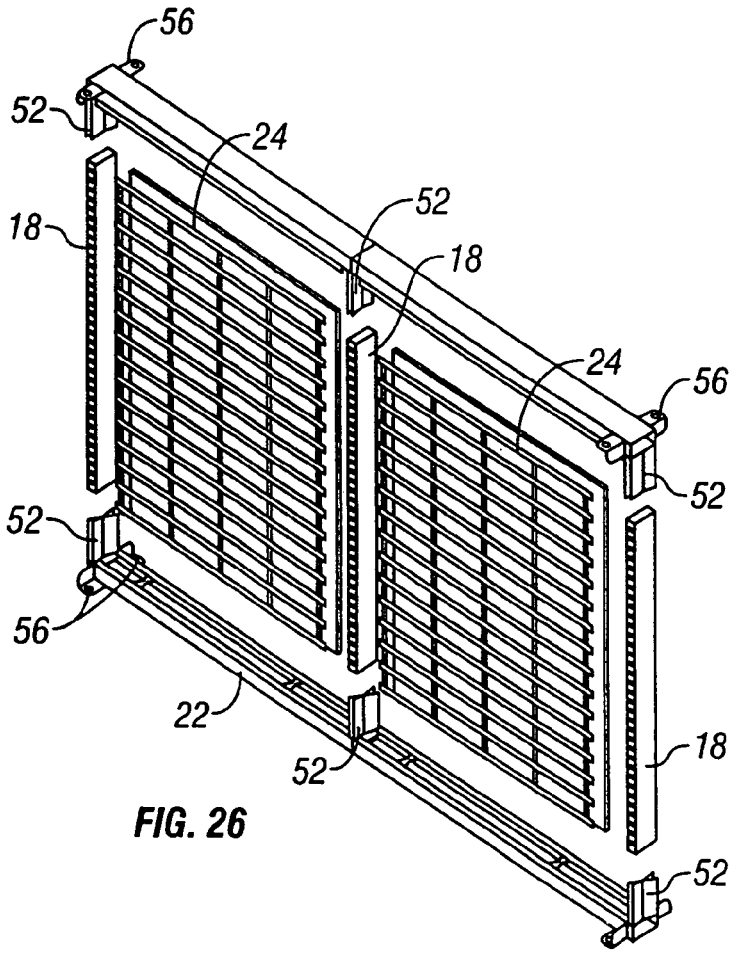
FIG. 26 is an exploded perspective view of a double panel section of the wall assembly illustrated in FIG. 19.

With continued reference to FIG. 25, a panel or wall 24 can be connected within the secondary uprights 18 and the support spacers 22 by being received within channels in the secondary uprights 18 and/or the support spacers 22. Alternatively, a panel or wall 24 can be secured in the rack assembly in other manners, such as with conventional fasteners or in any other manner described herein. If desired, any number of intermediate secondary uprights 18 can be connected to the support spacers 18 in any of the manners described above with reference to the connection between these elements in other embodiments. In FIG. 26 for example, an intermediate secondary upright 18 is preferably attached to upper and lower support spacers 22 by inserts 52 as described above. Multiple panels or walls 24 can be secured in such a wall assembly in any of the manners also described above.

In some preferred embodiments of the rack assembly illustrated in FIGS. 19-21, the positions of the secondary uprights 18 and support spacers 22 (if used) are adjustable. Specifically, the secondary uprights 18 and support spacers 22 can be located at different positions along the front-rear stretchers 16. With particular reference to FIGS. 19 and 21, flanges 52 of the support spacers 22 are provided with apertures 56 and can preferably be secured in different desired positions along the front-rear stretchers 16. In this regard, the front-rear stretchers 16 can be provided with apertures 54 along at least part of their length for connecting the support spacers 22 and the secondary uprights 18 to the front-rear stretchers 16 at different locations along the front-rear stretchers. Preferably, this connection is performed by passing threaded fasteners such as bolts or screws through aligned apertures 54, 56 in the front-rear stretchers 16 and the support spacers 22. Alternatives to bolts or screws include without limitation pins, posts, rivets, and other conventional fasteners. Most preferably however, the fasteners are releasable in order to enable adjustment of the position of the support spacers 22 and the secondary uprights 18 upon the front-rear stretchers 16.

Apertured flanges on the support spacers 22 provide a convenient manner in which to connect (and more preferably, adjustably connect) the support spacers 22 to the secondary front-rear stretchers 16. However, it will be appreciated by one having ordinary skill in the art that the support spacers 22 can be connected to the secondary front-rear stretchers 16 in a number of other manners. Also, the secondary uprights 18 can instead be connected to the secondary front-rear stretchers 16 in alternative embodiments to the rack assembly shown in FIGS. 19-21 (such as where inserts 52 on the ends of the secondary uprights extend laterally into the ends of the support spacers 22, providing an arrangement of elements in which the secondary uprights 18 are better positioned to be directly connected to the secondary front-rear stretchers 16). In any case, the secondary uprights 18 and/or the support spacers 22 can be connected to the secondary front-rear stretchers 16 in any manner described above with reference to the embodiment illustrated in FIGS. 1-9C.

As described above, the secondary front-rear stretchers 16 illustrated in FIGS. 19-21 are preferably connected to the uprights 10 of the warehouse-type rack assembly, and more preferably can be connected to the uprights 10 in different vertical positions along the uprights 10. In alternative embodiments, the secondary front-rear stretchers 16 illustrated in FIGS. 19-21 are supported by (and in some cases can also be connected to) the lateral stretchers 12 of the warehouse-type rack assembly in any manner, including those described above with reference to the embodiments of FIGS. 1-18C.

In some embodiments, the secondary front-rear stretchers 16 illustrated in FIGS. 19-21 are replaced by the front-rear stretchers 14 of the warehouse-type rack. In such embodiments, the secondary uprights 18 can be connected to the front-rear stretchers 14 (and more preferably, can be adjustably connected to the front-rear stretchers 14) in any of the manners described above with reference to the connections between the secondary uprights 18 and the secondary front-rear stretchers 16.

As noted above, the secondary uprights 18 can be connected to the front-rear stretchers 14 of a warehouse-type rack rather than to secondary front-rear stretchers 16. However, in some embodiments, one or more secondary uprights 18 are connected to front-rear stretcher(s) 14 of the warehouse-type rack while one or more other secondary uprights 18 are connected to secondary front-rear stretchers 16. For example, the left upper and lower front-rear stretchers shown in FIG. 21 can be secondary front-rear stretchers 16 as described above, while the right upper and lower front-rear stretchers shown in FIG. 21 can be front-rear stretchers 14 of the warehouse-type rack (and vice versa). Other stretcher combinations are possible and fall within the spirit and scope of the present invention.

In the illustrated preferred embodiments, an entire bay of a warehouse-type rack is shown "converted" by the conversion rack apparatus of the present invention. However, it should be noted that any part of the warehouse-type rack can be converted in this manner. For example, a user may desire to assemble a conversion rack according to the present invention only in half, a third, or a quarter of a full bay of a warehouse-type rack. By selecting the number and placement of the secondary front-rear stretchers 16 and secondary uprights 18 and the lengths of the stabilizer bars 20, support spacers 22, and panels or walls 24 (if used), any portion of a bay of a warehouse-type rack can be converted as described above. In addition to the advantages also described above, this provides the user with still more flexibility in the use of warehouse rack space.

As used in the appended claims, the term "coupled" does not necessarily mean that one element is fastened, secured, or otherwise attached to another element. Without limitation, the term "coupled" includes relationships between elements in which one element rests upon, engages, contacts, or is in mechanical communication with another element.

The embodiments described above and illustrated in the figures are presented by way of example only and are not intended as a limitation upon the concepts and principles of the present invention. As such, it will be appreciated by one having ordinary skill in the art that various changes in the elements and their configuration and arrangement are possible without departing from the spirit and scope of the present invention as set forth in the appended claims.

What is claimed is:

1. A method of converting a warehouse rack having a front, a rear, and opposite lateral ends into a merchandise storage and display rack, the method comprising:

positioning a first secondary front-rear stretcher between the opposite lateral ends of the warehouse rack, the first secondary front-rear stretcher elongated in a front to rear direction with respect to the warehouse rack;

laterally adjusting an upper lateral position of the first secondary front-rear stretcher between the opposite lateral ends of the warehouse rack;

supporting opposite ends of the first secondary front-rear stretcher upon the warehouse rack in the upper lateral position;

positioning a second secondary front-rear stretcher between the opposite lateral ends of the warehouse rack, the second secondary front-rear stretcher elongated in a front to rear direction with respect to the warehouse rack;

laterally adjusting a lower lateral position of the second secondary front-rear stretcher between the opposite lateral ends of the warehouse rack;

supporting opposite ends of the second secondary front-rear stretcher upon the warehouse rack in the lower lateral position; and coupling a secondary upright to the first and second secondary front-rear stretchers.

2. The method of claim 1, further comprising coupling a merchandise display and support element to the first and second secondary front-rear stretchers at a location between the front and the rear of the warehouse rack.

3. The method of claim 2, further comprising coupling a shelf to the merchandise storage and display rack and supporting the shelf on the first and second secondary front-rear stretchers.

4. The method of claim 2, further comprising adjusting the position of the merchandise storage and display rack on the first and second secondary front-rear stretchers between the front and the rear of the warehouse rack.

5. The method of claim 1, further comprising supporting the first secondary front-rear stretcher on a front primary lateral stretcher and a rear primary lateral stretcher.

6. The method of claim 5, further comprising supporting the front primary lateral stretcher and the rear primary lateral stretcher on a plurality of primary uprights.

7. The method of claim 1, further comprising supporting the weight of the first and second secondary front-rear stretchers entirely on the warehouse rack.

8. A method of converting a warehouse rack having a front, a rear, and opposite lateral ends into a merchandise storage and display rack, the method comprising:

placing a front end of an upper secondary front-rear stretcher in a first position laterally disposed from a front upright of the warehouse rack, the upper secondary front-rear stretcher elongated in a front to rear direction with respect to the warehouse rack;

laterally adjusting the first position of the upper secondary front-rear stretcher;

placing a rear end of the upper secondary front-rear stretcher in a second position laterally disposed from a rear upright of the warehouse rack;

laterally adjusting the second position of the upper secondary front-rear stretcher;

supporting the front and rear ends of the upper secondary front-rear stretcher upon the front and rear uprights of the warehouse rack, respectively;

placing a front end of a lower secondary front-rear stretcher in a third position laterally disposed from the front upright of the warehouse rack, the lower secondary front-rear stretcher elongated in a front to rear direction with respect to the warehouse rack;

laterally adjusting the third position of the lower secondary front-rear stretcher;

placing a rear end of the lower secondary front-rear stretcher in a fourth position laterally disposed from the rear upright of the warehouse rack;

supporting the front and rear ends of the lower secondary front-rear stretcher upon the front and rear uprights of the warehouse rack, respectively; and coupling a merchandise display rack and support element to the upper and lower secondary front-rear stretcher at a location between a front and a rear of the warehouse rack.

9. The method of claim 8, further comprising coupling a shelf to the merchandise storage and display rack and supporting the shelf on the upper and lower secondary front-rear stretchers.

10. The method of claim 9, further comprising adjusting a height of the shelf on the merchandise storage and display rack.

11. The method of claim 8, further comprising adjusting the position of the merchandise storage and display rack on the upper and lower secondary front-rear stretchers between the front and the rear of the warehouse rack.

12. The method of claim 8, further comprising supporting the upper secondary front-rear stretcher on a front primary lateral stretcher and a rear primary lateral stretcher.

13. The method of claim 12, further comprising supporting the front primary lateral stretcher and the rear primary lateral stretcher on a plurality of primary uprights.

* * * * *